US008683830B2

(12) United States Patent
Conti

(10) Patent No.: US 8,683,830 B2
(45) Date of Patent: Apr. 1, 2014

(54) PUSH PIN SECURITY DEVICE

(75) Inventor: Brian V. Conti, Matthews, NC (US)

(73) Assignee: Checkpoint Systems, Inc.

( * ) Notice: Subject to any disclaimer, the term of this patent is extended or adjusted under 35 U.S.C. 154(b) by 131 days.

(21) Appl. No.: 13/263,824

(22) PCT Filed: Apr. 9, 2010

(86) PCT No.: PCT/US2010/030538

§ 371 (c)(1),
(2), (4) Date: Oct. 10, 2011

(87) PCT Pub. No.: WO2010/118318

PCT Pub. Date: Oct. 14, 2010

(65) Prior Publication Data

US 2012/0031153 A1 Feb. 9, 2012

Related U.S. Application Data

(60) Provisional application No. 61/168,850, filed on Apr. 13, 2009, provisional application No. 61/168,462, filed on Apr. 10, 2009.

(51) Int. Cl.
*E05B 65/00* (2006.01)

(52) U.S. Cl.
USPC ..... 70/57.1; 206/387.11; 206/1.5

(58) Field of Classification Search
USPC ..... 70/57.1; 206/1.5, 387.11, 308.1, 308.2
See application file for complete search history.

(56) References Cited

U.S. PATENT DOCUMENTS 4,177,656 A * 12/1979 Davis ..... 70/84
4,984,698 A * 1/1991 Stuckey ..... 215/207
5,426,419 A 6/1995 Nguyen et al.
6,711,787 B2 * 3/2004 Jungkind et al. ..... 24/68 SK
7,073,236 B2 * 7/2006 Xue et al. ..... 24/704.1
7,190,272 B2 * 3/2007 Yang et al. ..... 340/572.8

(Continued)

FOREIGN PATENT DOCUMENTS

| | | | |
|---|---|---|---|
| DE | 10 2005 062414 | A1 | 6/2007 |
| EP | 0 021 849 | A1 | 1/1981 |
| EP | 1 091 063 | A2 | 4/2011 |
| WO | WO 2008/031325 | A1 | 3/2008 |

*Primary Examiner* — Suzanne Barrett

(57) ABSTRACT

A security device is provided for attachment to an object having one or more security features for preventing unwanted removal of the security device from the object. The security device may include any one of a surveillance device, such as an electronic article surveillance tag, and an inventory device, such as a radio frequency identification tag. In a particular embodiment, the security device has at least two security features, one security feature comprises a support member that is configured to engage a head of a key, wherein the key is configured to provide a force to allow the support member to move a clip between a first state, a state that prevents the release of a pin from the clip, and a second state, a state whereby the clip allows the release of the pin from the clip. Another security feature comprises a lock moveable between a locked position, the locked position preventing the support member from moving the clip from the first state to a second state, and an unlocked position, the unlocked position allowing the support member to move the clip from the first state to a second state. A key is also provided, the key configured to apply at least two forces to a security device, one of the at least two forces respectively applied to each of at least two security features of the security device.

24 Claims, 44 Drawing Sheets

(56) References Cited

U.S. PATENT DOCUMENTS

| | | | | |
|---|---|---|---|---|
| 7,215,250 | B2 * | 5/2007 | Hansen et al. | 340/572.9 |
| 7,400,254 | B2 * | 7/2008 | Yang et al. | 340/572.1 |
| 7,474,222 | B2 * | 1/2009 | Yang et al. | 340/572.8 |
| 7,624,889 | B2 * | 12/2009 | Tharp et al. | 220/288 |
| 7,652,574 | B2 * | 1/2010 | Sayegh | 340/568.1 |
| 8,344,891 | B2 * | 1/2013 | Appalucci et al. | 340/572.9 |
| 2005/0091809 | A1 * | 5/2005 | Xue et al. | 24/704.1 |
| 2007/0067971 | A1 * | 3/2007 | Nguyen et al. | 24/704.1 |
| 2007/0080806 | A1 | 4/2007 | Lax et al. | |
| 2007/0096925 | A1 | 5/2007 | Yang et al. | |
| 2007/0169524 | A1 * | 7/2007 | Tharp et al. | 70/172 |
| 2007/0256715 | A1 * | 11/2007 | Oppel et al. | 134/57 DL |
| 2010/0225485 | A1 * | 9/2010 | Appalucci et al. | 340/572.9 |
| 2012/0032805 | A1 * | 2/2012 | Brodzik et al. | 340/572.8 |

* cited by examiner

1. POSITION TAG AND PIN (TYPICAL TO PIERCE THROUGH MERCHANDISE TO SECURE)
100
200
300

100
200
300

2. PUSH PIN INTO TAG, TAG RETAINS PIN, TAG SECURED TO MERCHANDISE
A
150
160
500
100

3. TO REMOVE, ALIGN KEY TO TAG (VISUAL ALIGNMENT IN ADDITION TO THE MALE KEY AND FEMALE TAG BEING KEY VIA GEOMETRIC

4. KEY ENGAGED WITH TAG
150
100

150
100

5. KEY TWIST/ROTATES TO DISENGAGE PIN FROM TAG
150
200
300
100
6. WITH KEY ROTATED, AND LIFTED, PIN RELEASES FROM TAG

A magnetic field produced by the magnet of the key and the lock elements of the lock and allows the magnetic force to move the lock from a locked position to the unlocked position by moving the lock elements inwardly to disengage.

WHEN ROTATED, THE INNER GREY PART HAS GEOMETRY THAT 'CAMS' THE VERTICAL 'ARMS' OF THE BLUE PART OUTWARD.

METAL (YELLOW) PART PREVENTS ROTATION OF INNER PART WITH RESPECT TO OUTER HOUSING. WHEN THE MAGNETIC KEY IS APPLIED, THE METAL PART ATTRACTS/REFLECTS INWARD ALLOWING THE INNER PART TO ROTATE VIA TWIST OF THE KEY.

MATING "KEY" FEATURES BETWEEN DEVICE (TAG SHOWN) AND KEY

PUSH PIN SECURITY DEVICE

CROSS-REFERENCE TO RELATED APPLICATIONS

The present application is a national stage entry of International Application No. PCT/US10/30538, filed Apr. 9, 2010. The present application also claims the benefit of U.S. Provisional Patent Application Ser. No. 61/168,850, filed Apr. 13, 2009 and U.S. Provisional Patent Application No. 61/168,462 filed Apr. 10, 2009, the entireties of which are incorporated herein by reference.

FIELD OF INVENTION

The present invention relates to a security device for attachment to an object, the security device configured to prevent the unwanted removal of the security device from the object. The present invention additionally relates to a key to unlock a security device from an object, the key is configured to apply at least two forces to the security device to allow removal of the security device from the object.

BACKGROUND

Electronic article surveillance (EAS) systems are often used to deter and detect shoplifting. Typically, an EAS security system includes an EAS tag, a transmitter, a receiver, and an alarm. The EAS tag is attached to a piece of merchandise. The transmitter and the receiver are positioned at the exit of a retail establishment and are configured to establish a detection zone in which a consumer must pass through as he or she exits the retail establishment. The transmitter is configured to send signals through the detection zone. When an EAS tag enters the detection zone, the EAS tag responds and creates a signal or a change or disturbance in the original signal transmitted by the transmitter, which is detectable by the receiver. Upon detection of the EAS tag, the alarm is triggered in order to notify the store personnel that someone is trying to exit the retail establishment with merchandise that has an attached and active EAS tag.

In an EAS system, it is the actual EAS tag that is being detected and not the merchandise itself. Therefore, an EAS system can be circumvented by removing the EAS tag from the merchandise. Security devices have been developed to prevent the unauthorized removal of the EAS tag.

BRIEF SUMMARY

The present invention relates to a security device for attachment to an object, the security device is configured to prevent the unwanted removal of the security device from the object. Without intending to be bound by theory, a security device of the invention comprises at least two security features configured to prevent the unwanted removal of the security device from an object. The present invention also relates to a key to unlock a security device from the object, the key configured to apply at least two forces to the security device to allow removal of the security device from the object.

Various embodiments of the invention are directed to a security device structured for attachment to an object. In one embodiment, the security device comprises a clip that may be moved from a first state, where the clip secures at least a portion of a pin, to a second state, where the pin is released from the clip, and a support member, which is positioned proximate to the clip, the support member defining a cam surface that engages the clip. Rotation of the support member operates to move the clip from the first state to the second state.

In another embodiment of the invention, the clip defines an opening that receives at least a portion of the pin and the support member defines a channel for receiving at least a portion of the pin, the opening of the clip and the channel are positioned in substantially concentric alignment.

In another embodiment of the invention, the clip defines a base, a first arm, and a second arm. The first and second arms define a rest angle relative to the base of the clip when in the first state and a flex angle relative to the base of the clip when in the second state.

In yet another embodiment of the invention, the clip defines an opening having a first size for securing at least a portion of the pin when the clip is in the first state, and a second size, larger than the first size, for releasing the pin when the clip is in the second state.

In another embodiment of the invention, the support member defines a key structure that may receive a reciprocally configured key structure of a key, which may be used to rotate the support member.

In certain embodiments of the invention, the security device may further comprise a lock, the lock is moveable between a lock position—preventing rotation of the support member—and an unlock position—allowing rotation of the support member. In another embodiment of the invention, a magnetic force operates to move the lock from the lock position to the unlock position. In certain embodiments of the invention, the lock may define first and second lock elements that are deflected inwardly upon application of the magnetic force.

In another embodiment of the invention, the security device further comprises a housing, the housing is configured to rotationally constrain the lock in the lock position. The housing may at least partially enclose the lock, the support member, and the clip. In another embodiment of the invention, a housing at least partially encloses the lock and the housing defines an obstruction to rotationally constrain the lock in the lock position. Application of a magnetic force operates to move the lock from the lock position to the unlock position where the lock is free from the obstruction.

The security device may further comprise a security element. In an embodiment of the invention, the security device is an electronic article surveillance tag. In another embodiment of the invention, the security element is a radio frequency identification tag.

Another embodiment of the invention provides a security device that is structured for attachment to an object, the security device comprising a clip that is configured to move between a first state, where the clip secures at least a potion of a pin, and a second state, where the clip releases the pin. The movement of the clip between the first state and the second state is possible only upon the security device receiving application of a first force and a second force.

In another embodiment of the invention, the first force and the second force are applied to the security device by a key. In yet another embodiment of the invention, the first force is a rotational force and the second force is a magnetic force. In certain embodiments, the first force that is a rotational force is applied about an axis of rotation, and the second force that is a magnetic force is operable in a direction generally orthogonal to the axis of rotation.

In another embodiment of the invention, the security device further comprises a support member positioned proximate to the clip, the support member defining a cam surface that engages the clip and the rotation of the support member operates to move the clip from the first state to the second state.

In another embodiment of the invention, the clip has a base and first and second arms that define a rest angle relative to the base when the clip is in the first state and a flex angle relative to the base when the clip is in the second state.

In another embodiment of the invention, the clip may also define an opening having a first size for securing at least a portion of the pin when in the first state and a second size, larger than the first size, for releasing the pin when in the second state. Pursuant to this embodiment, the support member additionally defines a channel for receiving at least a potion of the pin and the channel and the opening of the clip are in substantially concentric alignment.

In another embodiment of the invention, the support member defines a key structure that receives a reciprocally configured key structure of a key that may be used to rotate the support member. The security device may additionally comprise a lock that is moveable between a lock position where it prevents rotation of the support member and an unlock position where it allows rotation of the support member. In certain embodiments of the invention, the lock may have first and second lock elements, which become deflected inwardly upon application of a magnetic force.

In another embodiment of the invention, the security device additionally comprises a housing that is configured to rotationally constrain the lock in the lock position. The housing may also be configured to at least partially enclose the lock, the support member, and the clip.

In yet another embodiment of the invention, the security device comprises a housing that at least partially encloses the lock. Pursuant to this embodiment, the housing defines an obstruction configured to rotationally constrain the lock in the lock position. Application of a magnetic force operates to move the lock from the lock position to the unlock position where the lock becomes free of the obstruction.

According to another embodiment of the invention, a security device structured for attachment to an object is provided, the security device comprising a securing mechanism and a support member. The securing mechanism is configured to be moveable between a first state and a second state, the securing mechanism configured to prevent access to the security device in the first state and further configured to allow access to the security device in the second state. The support member is positioned proximate to the securing mechanism and is configured to engage the securing mechanism. A movement, such as a rotational or axial movement, of the support member operates to drive the securing mechanism from a first state to the second state.

In another embodiment of the invention, the support member defines a key structure that is configured to receive a reciprocally configured key structure of a key that may be used to invoke the movement of the support member.

In another embodiment of the invention, the security device further comprises a lock that is moveable between a lock position and an unlock position. The lock is structured to prevent the movement of the support member in the lock position and to allow the movement of the support member in the unlock position. In certain embodiments of the invention, application of a magnetic force operates to move the lock from the lock position to the unlock position. In another embodiment of the invention, the lock defines first and second lock elements that are deflected inwardly upon application of the magnetic force.

In another embodiment of the invention, the security device further comprises a housing that is configured to constrain the lock in the lock position. In certain embodiments of the invention, the housing is configured to at least partially enclose the lock, the support member, and the securing mechanism.

In another embodiment of the invention, the security device further comprises a housing that at least partially encloses the lock. The housing defines an obstruction to constrain the lock in the lock positions. The application of a magnetic force operates to move the lock from the lock position to the unlock position where the lock is free of the obstruction.

According to another embodiment of the invention, a key that is structured to unlock a security device comprises a body and a head extending form the body, the head comprising a key structure adapted to mechanically engage a reciprocally configured key structure of the security device and a magnetic element that is at least partially supported by the key structure.

In another embodiment of the invention, the head of the key extends from the body generally along an insertion axis and the magnetic element produces a magnetic force that is operable in a direction generally orthogonal to the insertion axis.

According to another embodiment of the invention, a key is provided to allow removal of a security device from an object, the security device having at least two security features configured to prevent unwanted removal of the security device from the object. The key is configured to apply at least two forces, one of the at least two forces respectively corresponding to each of the at least two security features. In an embodiment of the invention, the key comprises a head configured to engage a support member of the security device.

In an embodiment of the invention, one of the at least two forces is applied to the support member of the security device causing the support member to move a clip of the security device from a first state, the first state configured to prevent a release of a pin from the clip, to a second state, the second state configured to allow the release of the pin from the clip. Pursuant to this embodiment of the invention, the force applied to the support member may be a rotational force.

Other aspects and embodiments will become apparent upon review of the following description taken in conjunction the accompanying drawings. The invention, though, is pointed out with particularity by the appended claims.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figures 1A, 1B, 1C:
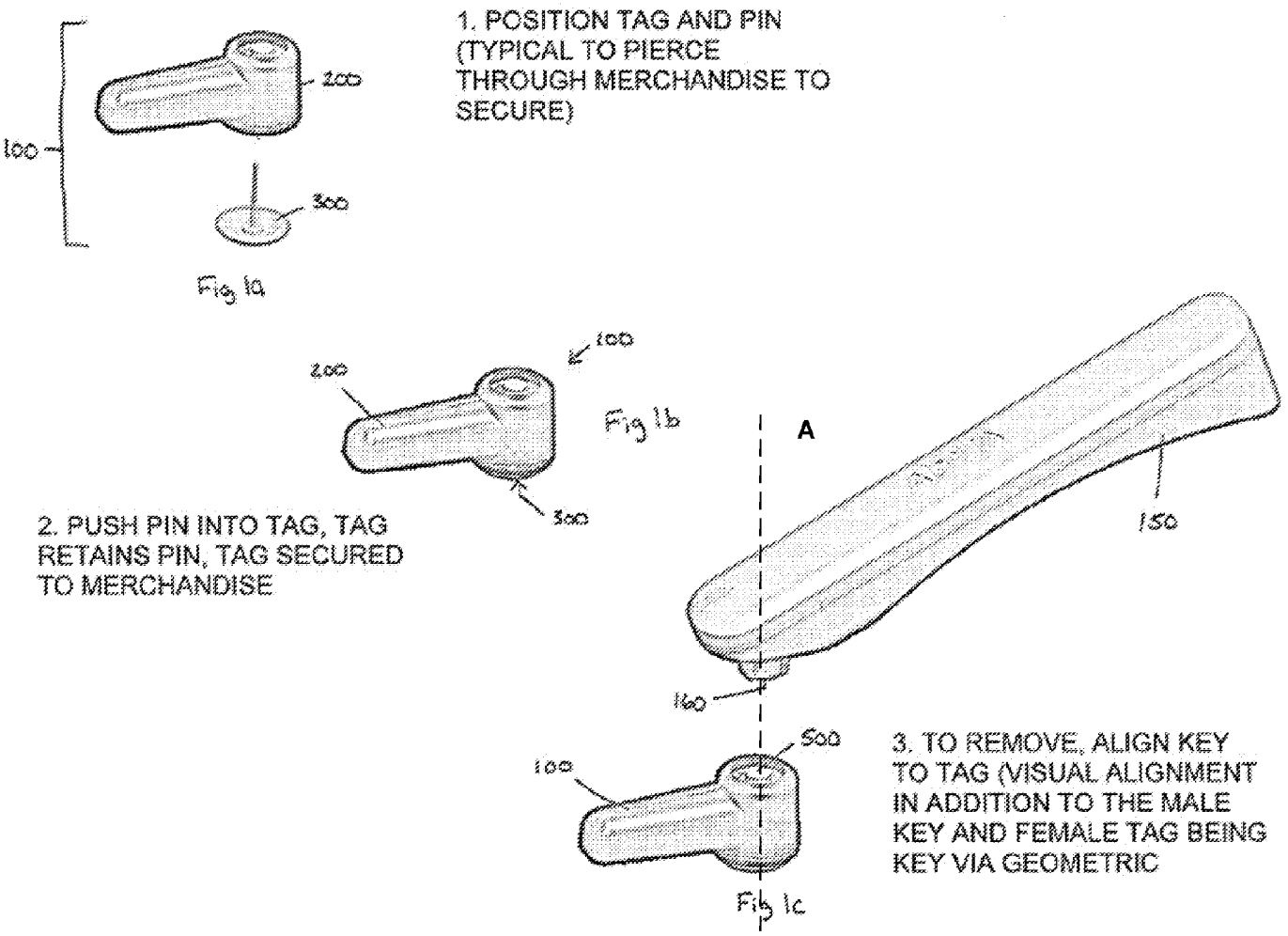
FIG. 1*a* is a perspective view of a security device that includes a tag housing and a pin according to an exemplary embodiment of the present invention.
FIG. 1*b* is the security device shown in FIG. 1*a* with the pin inserted into the tag housing.
FIG. 1*c* is the security device shown in FIGS. 1*a* and 1*b* and a key according to an exemplary embodiment of the present invention.
Figures 1D, 1E, 1F:
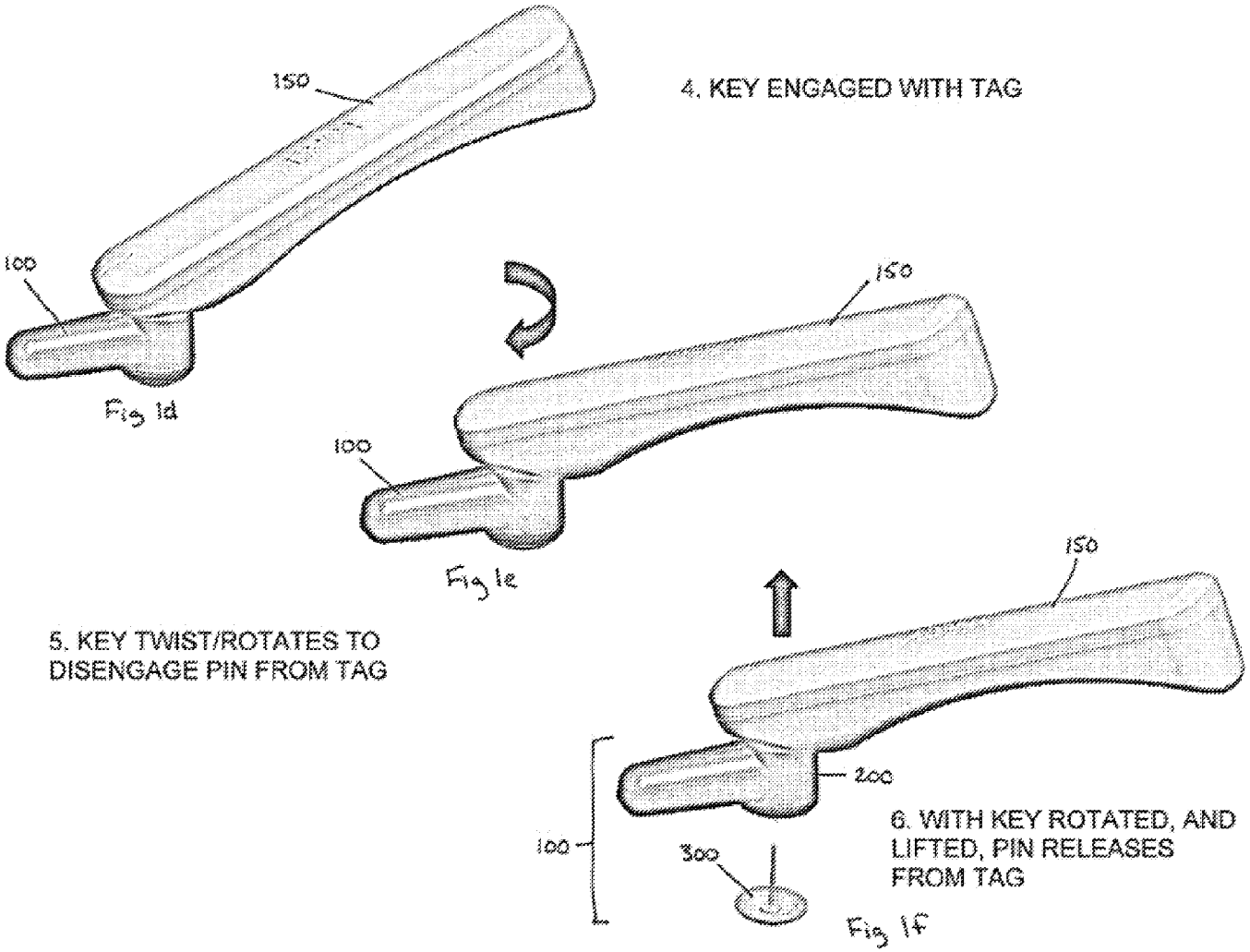
FIG. 1*d* is the security device and the key shown in FIG. 1*c* in a first position.
FIG. 1*e* is the security device and the key shown in FIG. 1*c* in a second position.
FIG. 1*f* is the security device and the key shown in FIGS. 1*c* through 1*e* with the pin released from the tag housing.

The present invention or inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As used in the specification and in the appended claims, the singular forms "a", "an", and "the" include plural referents unless the context clearly indicates otherwise. For example, reference to "a key" includes a plurality of such keys.

It will be understood that relative terms, such as "preceding" or "followed by" or the like, may be used herein to describe one element's relationship to another element as illustrated in the Figures. It will be understood that relative terms are intended to encompass different orientations of the elements in addition to the orientation of elements as illustrated in the Figures. It will be understood that such terms can be used to describe the relative positions of the element or elements of the invention and are not intended, unless the context clearly indicates otherwise, to be limiting.

Embodiments of the present invention are described herein with reference to various perspectives, including perspective views that are schematic representations of idealized embodiments of the present invention. As a person having ordinary skill in the art to which this invention belongs would appreciate, variations from or modifications to the shapes as illustrated in the Figures are to be expected in practicing the invention. Such variations and/or modifications can be the result of manufacturing techniques, design considerations, and the like, and such variations are intended to be included herein within the scope of the present invention and as further set forth in the claims that follow. The articles of the present invention and their respective components illustrated in the Figures are not intended to illustrate the precise shape of the component of an article and are not intended to limit the scope of the present invention.

Embodiments of the present invention provide a security device (in the figures the security device is also referred to simply as a "tag"). The security device may be configured to secure to merchandise or other objects and to prevent the unauthorized removal or tampering of the security device. In general, the security device includes a securing mechanism that is configured to prevent access to the security device in a first state and allow access to the security device in a second state. The security device also generally includes a support member that engages the securing mechanism and is configured such that a movement of the support member operates to drive the securing mechanism form the first state to a second state. Without intending to be limiting, the movement of the support member may be a rotational movement, an axial movement, a movement defined by a switch, a movement defined by a ratchet, and any combination thereof.

The securing mechanism may include any number of devices that are configured to prevent unauthorized access but allow authorized access to a security device. For example, the securing mechanism may be a clip as further described herein. In other embodiments of the invention, the securing mechanism may include a lock assembly for securing a tote as that described in U.S. patent application Ser. No. 12/630,372 entitled "Locking Device for Tote Bin" fully incorporated herein by reference. In other embodiments, the securing mechanism may be a lock assembly structured to secure a cable wrap device such as Alpha Security Products' Spider Wrap™ disclosed in U.S. Pat. No. 7,162,899, which is herein incorporated by reference in its entirety. Further, the securing mechanism may be an assembly for locking a cable lock, such as the Alpha Security Products' Cablelok™ device disclosed in U.S. Pat. No. 7,249,401, which is herein incorporated by reference in its entirety. The securing mechanism may also comprise an assembly for locking a keeper, such as that disclosed in U.S. Pat. No. 6,832,498, which is herein incorporated by reference in its entirety. In still other embodiments of the invention, the securing mechanism may comprise a latch moveable between a locked and an unlocked state for securing, for example, an access door or another assembly that functions as part of the security device to secure, for example, an object.

The security device may also include a housing. The housing may be configured to hold an EAS tag or other security element. The housing may further be configured to hold and support various device components including the clip or securing mechanism, the support member, and the lock.

In an embodiment of the invention, the support member defines a key structure that is configured to receive a reciprocally configured key structure of a key. As will be discussed in greater detail below, the reciprocally configured key structures ensure that only specifically configured keys are able to unlock (i.e., rotate the support member) the security device.

The security device may also comprise a lock, the lock that is moveable between a lock position and an unlock position. The lock is configured to prevent movement of the support member in the lock position and to allow movement of the support member in the unlock position. In certain embodiments of the invention, application of a magnetic force operates to move the lock from the lock position to the unlock position.

Certain embodiments of the present invention provide a security device that may be configured to secure to merchandise or other objects and to prevent unauthorized removal or tampering of the security device. In one embodiment, as shown in FIGS. 1*a* through 1*f*, the security device 100 includes a housing 200 and a pin 300. The housing 200 is configured to hold an EAS tag or other security element and, thus, the housing 200 is also referred to herein as the tag housing. The pin 300 is configured to extend through merchandise and into the housing 200 such that the pin 300 secures the housing and, thus, the EAS tag, to the merchandise. The pin 300 and the housing 200 are further configured to engage in such a manner that the pin 300 is not removable from the housing 200 without the use of a specifically configured key 150.

More specifically and according to the illustrated embodiment, the security device includes the housing 200, the pin 300, a clip 400, a support member 500, and a lock 600 (as shown in FIGS. 9*a*-9*d*). The clip 400 is configured to receive the pin 300. In a first state, the clip 400 is configured to prevent the release of the pin 300 from the housing 200. In a second state, the clip 400 is configured to allow the release of the pin 300 from the housing 200.

The support member 500 is configured to rotate and thereby drive movement of the clip 400 between the first and second states. As discussed in greater detail below, the lock 600 is configured to lock the support member 500 such that support member 500 is unable to rotate and move the clip 400 and, thus, prevent the release the pin 300. The support member 500 is configured to be engaged by a specifically shaped key 150. Among other things, the key 150 is configured to move the lock between the unlocked and locked configurations by rotating the support member and applying a magnetic force.

Figure 8A:
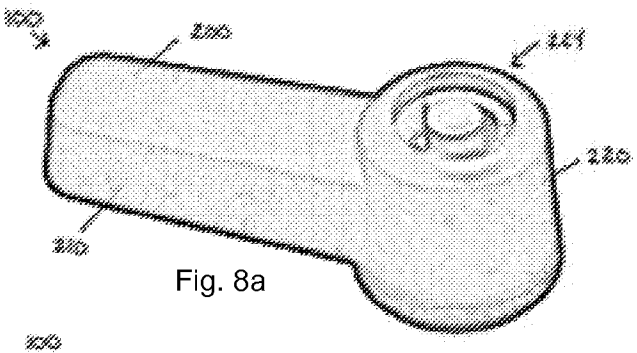
FIG. 8*a* is a perspective view of the security device of FIG. 1*b;*
Figure 8B:
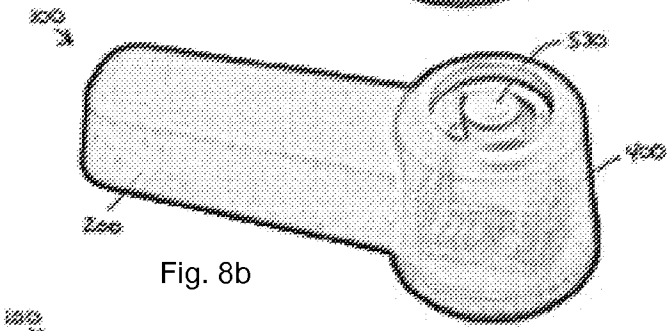
FIG. 8*b* is a partially transparent perspective view of the security device of FIG. 8*a* with the clip highlighted.
Figure 8C:
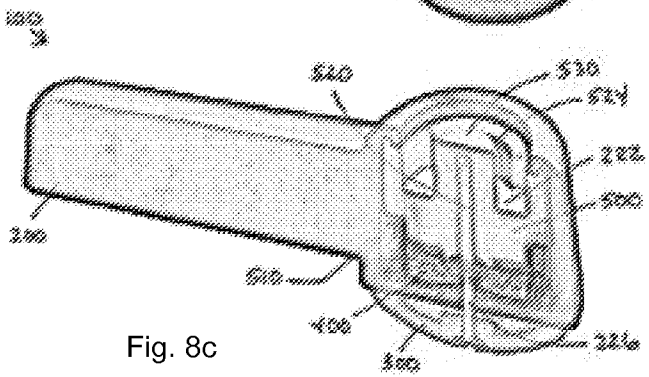
FIG. 8*c* is a perspective cross-sectional view of the security device of FIG. 8*a;*
Figure 8D:
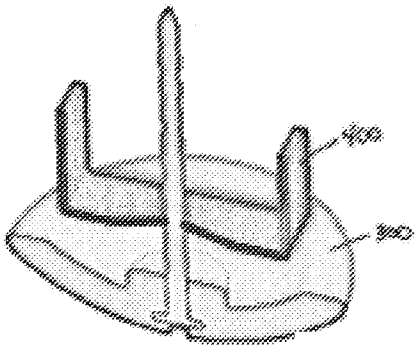
FIG. 8*d* is a perspective cross-sectional view of the clip and pin shown in FIG. 8*c;*
Figure 9A:
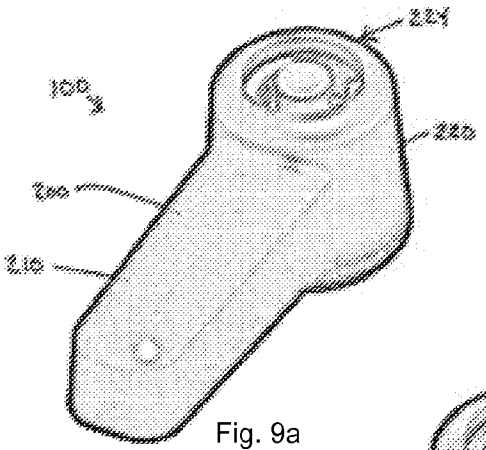
FIG. 9*a* is a perspective view of the security device of FIG. 1*b;*
Figure 9B:
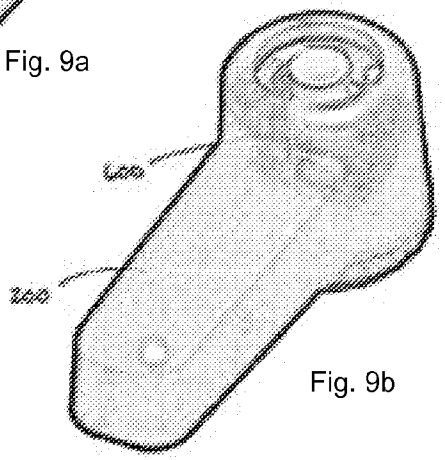
FIG. 9*b* is a partially transparent perspective view of FIG. 9*a* with the lock highlighted.
Figure 9D:
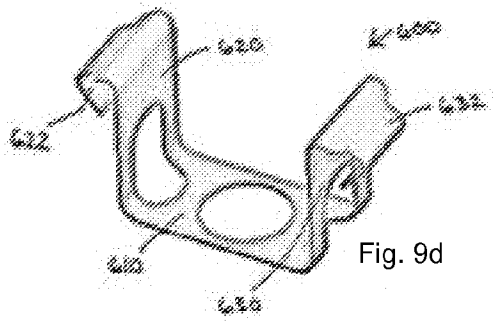
FIG. 9*d* is a perspective view of the lock shown in FIGS. 9*b* and 9*c;*
Figure 9C:
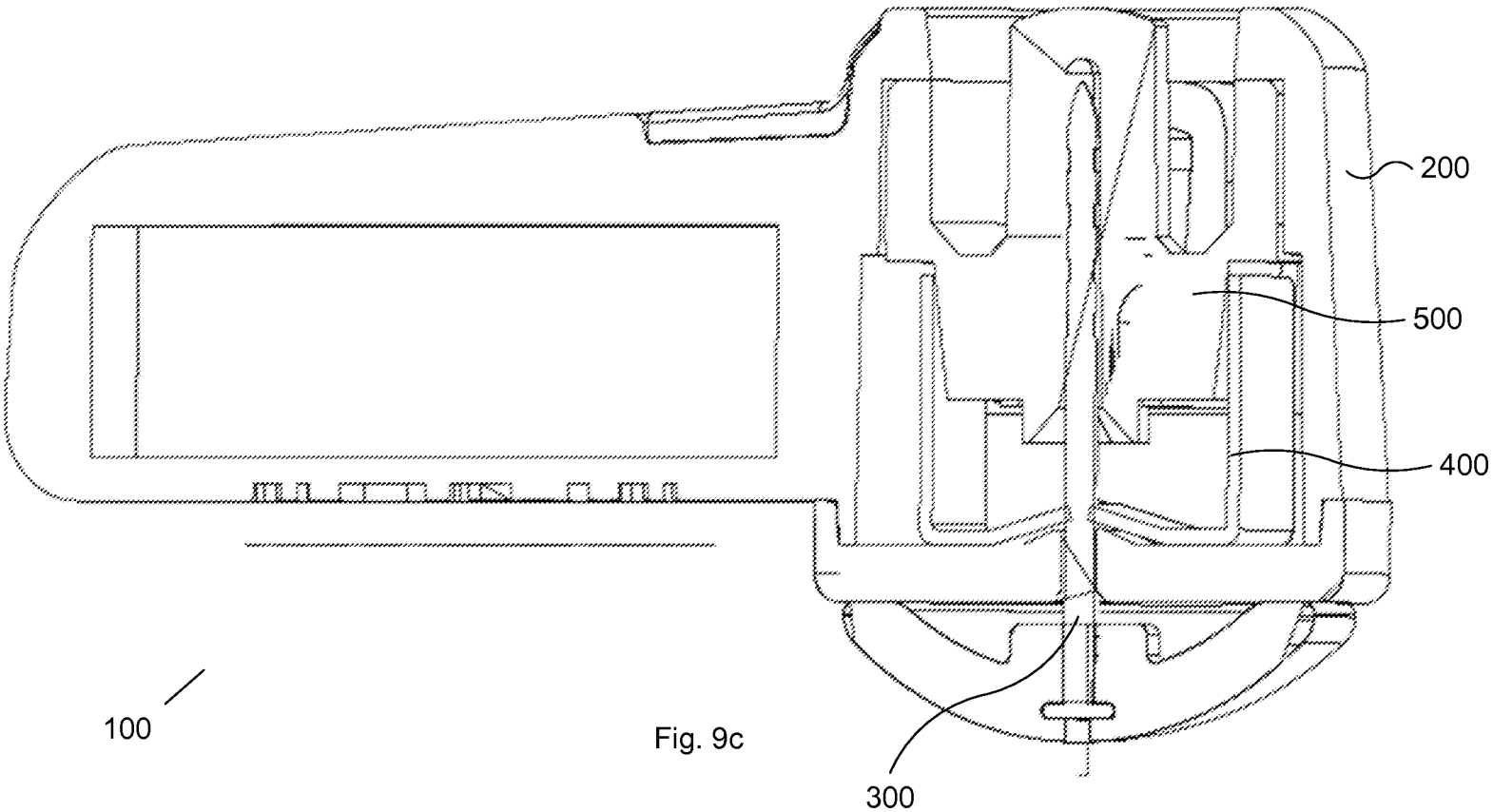
FIG. 9*c* is a perspective cross-section view of a portion of the housing, the clip, the lock, and a support member according to an exemplary embodiment of the present invention taken along line A-A of FIG. 16*a;*

As shown in FIGS. 8*a* and 9*a*, the housing 200 includes a first portion 210 and a second portion 220. The first portion 210 defines an interior for storing or containing an EAS tag or other surveillance or inventory device, collectively also known herein as a security element, such a radio frequency identification (RFID) tag. In the depicted embodiment, the EAS tag is completely enclosed such that it is inaccessible to consumers or would-be thieves. The second portion 220 defines a cavity 222 configured to house at least partially the clip 400, the support member 500, and the lock 600, e.g., as shown in FIGS. 8*c* and 9*c*. The cavity 222 may include a top opening 224 for receiving the key, e.g., as shown in FIGS. 1*c* through 1*f*, and a bottom opening 226 for receiving the pin, e.g., as shown in FIGS. 8*c* and 9*c*.

As shown in FIGS. 4*a* through 7*b*, the pin 300 may include a head 310 and a rod 320. The rod 320 extends from the head 310 to a distal end 322. The distal end 322 may be sharpened to facilitate piercing of the pin through the merchandise (e.g., clothing). The rod 320 may define one or more grooves 324. Each groove 324 may extend along the circumference of the rod 322. The grooves 324 may be spaced apart along the length of the rod 320 between the distal end 322 and the head 310.

The clip 400 includes a base 410, a first arm 420, and a second arm 430. The base 410 extends from a first end to a second end. The first arm 420 extends from the first end upwardly and generally perpendicular to the base 410. The second arm 430 extends from the second end upwardly and generally perpendicular to the base 410. The base 410 includes two flap elements 412 that define an opening 414 between the two flap elements 412. The flap elements 412 are moveable. As the flap elements 412 move upwardly, the opening expands. However, the flap elements 412 are biased to a first position, e.g., as shown FIG. 4*a*. Therefore, without a continuing force applied to the flap elements 412, the flap elements 412 have the tendency to return to the first position and, thus, return the opening 414 to the size that corresponds to the first position.

The depicted clip 400 is formed from stamped sheet metal such as tempered spring steel. However, in other embodiments, the clip may be formed from other rigid, yet elastically resilient, materials such as plastics.

Figures 5A, 5B, 5C:
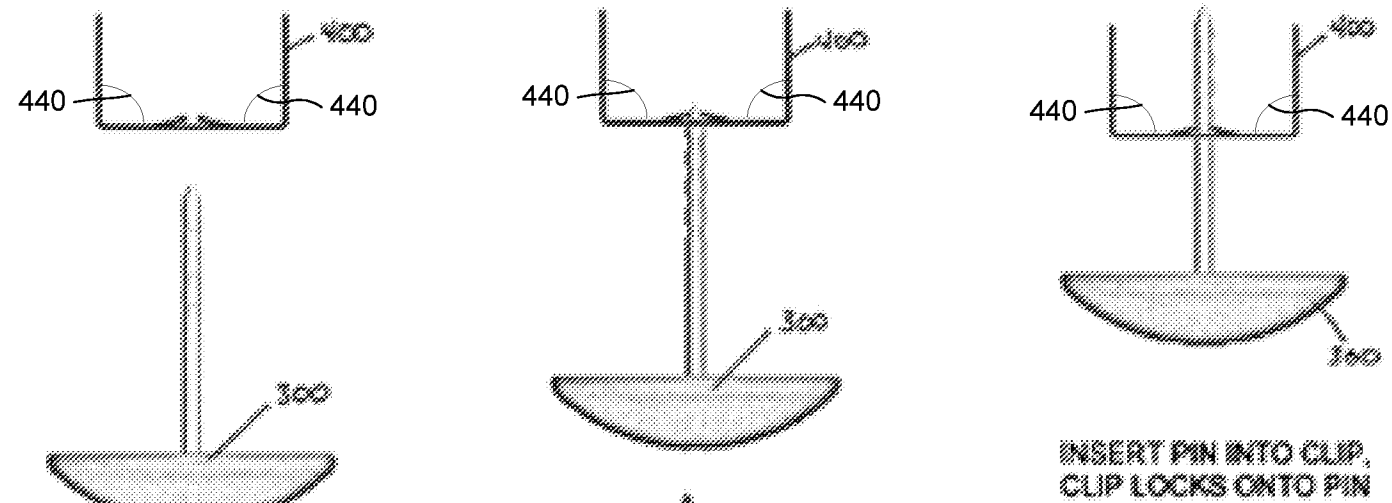
FIG. 5*a* is a side view of the pin and the clip of FIG. 4*a;*
FIG. 5*b* is a side view of the pin and the clip of FIG. 5*a* in which the pin is about to engage the clip.
FIG. 5*c* is a side view of the pin and the clip of FIG. 5*b* with the pin and clip in an engaged configuration.

During operation and as shown in FIGS. 5*a* and 5*b*, the pin 300 is inserted through the opening 414 of the clip 400. More specifically, as shown in FIG. 5*b*, the distal end of the pin 300 is pushed through the opening 414. As the distal end and the rest of the rod passes through the opening, the rod may force the flap elements 412 upwardly and thus expand the opening enough to allow the rod to pass. As shown in FIG. 5*c*, as each groove 324 defined in the rod 320 passes the flap elements 412, due to the smaller cross-section of the rod 320 at the groove 324, the flap elements 412 move downwardly (spring back) and into the groove 324 of the rod 320. With the flap elements 412 in the groove 324, although the pin 300 is able to be further inserted into the clip 400 (i.e., in the upward direction in the figures), the pin 300 is unable to be retracted out of the clip 400 (i.e., in the downward direction in the figures). In other words, due to the geometry of the flap elements 412 and the rod 320 of the pin 300, once the pin 300 is inserted into the clip 400, the pin 300 is unable to be released without application of the key, which is discussed in greater detail below.

In another embodiment, as shown in FIGS. 8*a* through 8*e*, the clip 400 is positioned within the cavity 222 of the housing 200 such that the opening 414 of the clip 400 and the bottom opening 226 of the cavity are aligned. When the pin 300 is inserted into the housing 200 through the bottom opening 226, due to the alignment of the openings 226, 414, the rod of the pin 300 is also inserted through the clip 400. Therefore, by preventing the release of pin from the clip, the pin is also preventing the release of the pin from the housing.

Figure 7B:
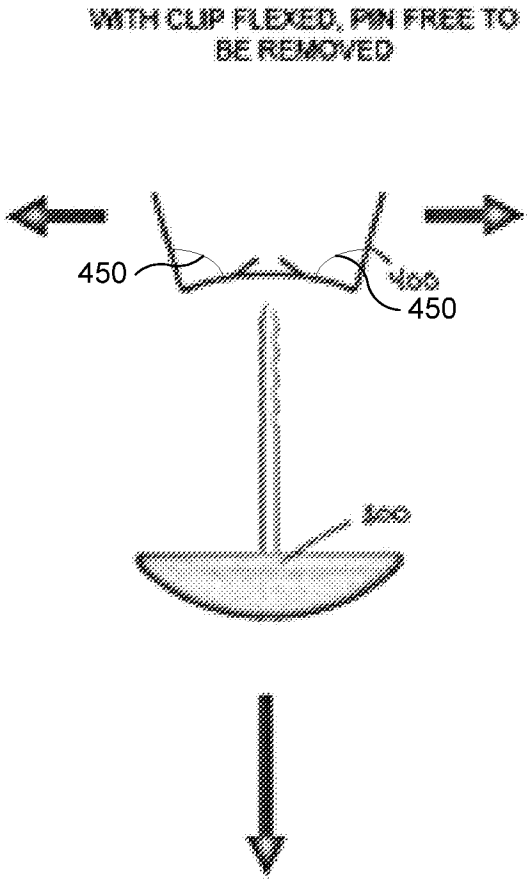
FIG. 7*b* is a side view of the pin and the clip of FIG. 6*b;*
Figure 7A:
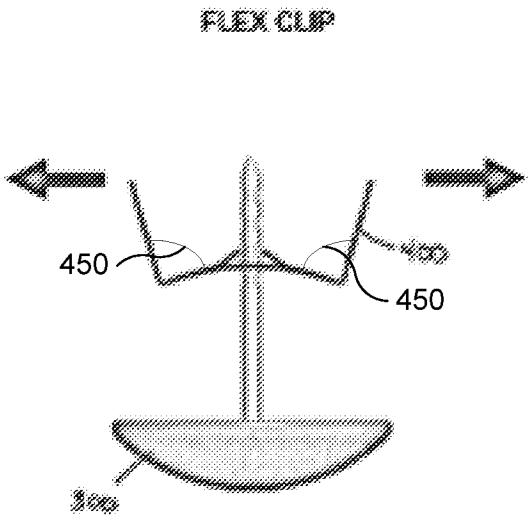
FIG. 7*a* is a side view of the pin and the clip of FIG. 6*a;*

The support member 500 is configured to move the clip 400 from a first state, referred to as a rest state, e.g., as shown in FIG. 5*a*, to a second state, referred to as a flexed state, e.g, as shown in FIG. 7*a*. In the rest state, the clip 400 is in a configuration as described above in which once the pin 300 is inserted, through the opening 414, the pin 300 is pre-vented from being released from the clip 400. In the second state, the clip 400 is in a configuration in which the pin 300 is releasable from the clip and/or housing. In one embodiment of the invention, rotation of the support member 500 operates to drive the clip 400 from the first state to the second state.

Figure 8E:
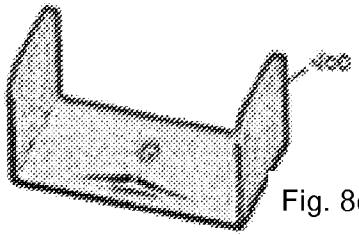
FIG. 8*e* is a perspective view of the clip shown in FIG. 8*c;*
Figure 9E:
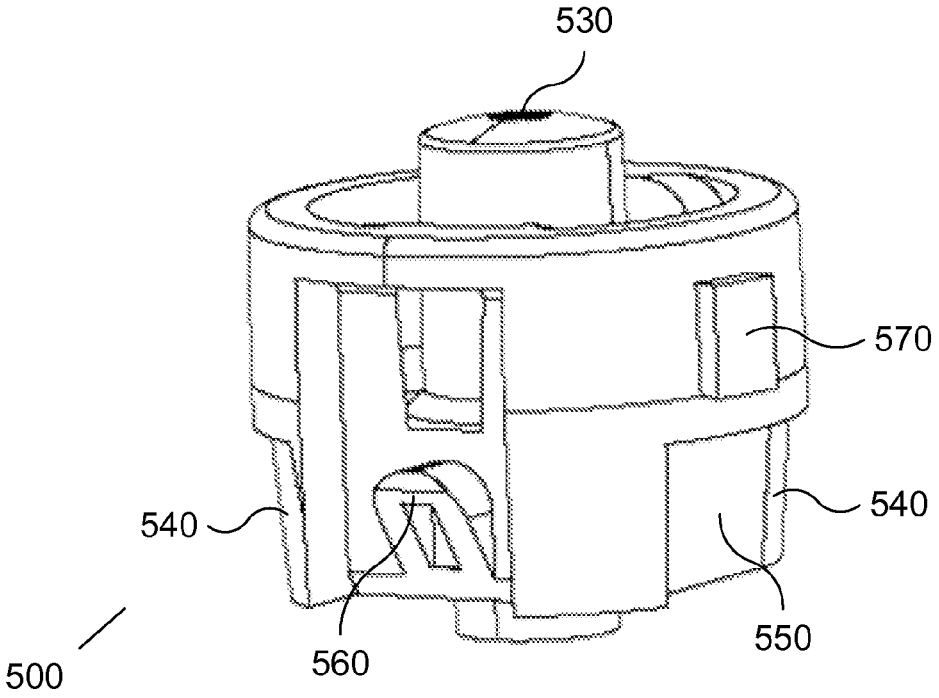
FIG. 9*e* is a perspective view of a support member of the invention.
Figure 18:
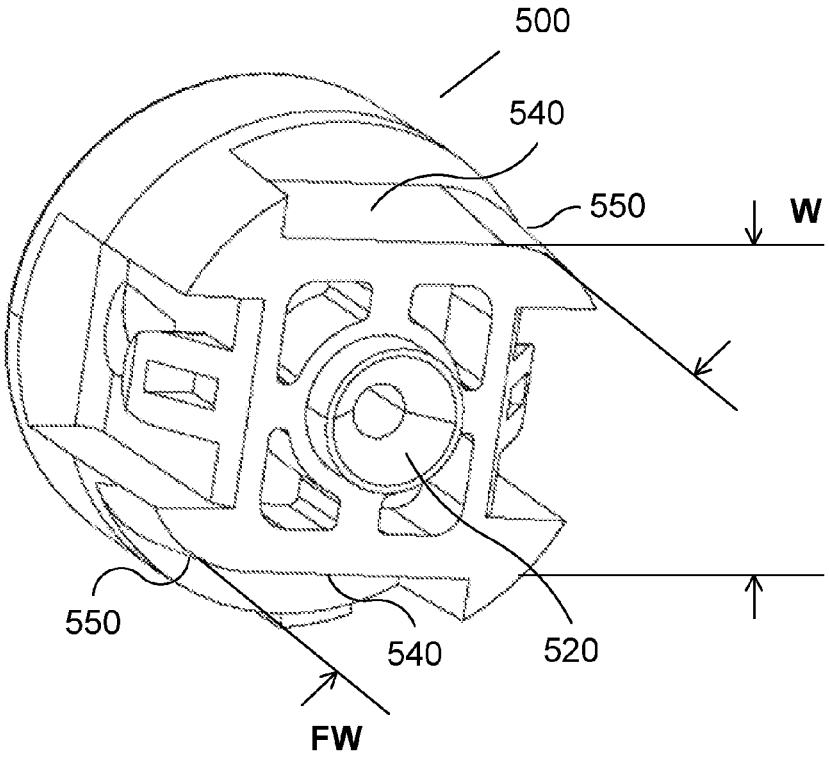
FIG. 18 is an isometric view of the bottom of the support member as shown in FIG. 8*c;*

For example, in the illustrated embodiment, the support member 500 is rotatably supported within the cavity 222 of the housing 200. The support member 500 may include one or more engaging or camming surfaces 540 (as shown in FIGS. 9*e* and 18) that are positioned near the arms 420, 430 of the clip 400, e.g., as shown in FIGS. 8*a* through 8*e*. The first and second arms 420, 430 define a rest angle 440 relative to the base 410 when the clip 400 is disposed in the first state. As the support member 500 rotates, the camming surfaces 540 of the support member engage the arms 420 & 430 of the clip 400 thereby driving the clip 400 from the first state to the second state.

Turning for example to FIGS. 9*e* and 18, in one embodiment, the support member defines camming surfaces 540 on opposite sides of the support member 500. The camming surfaces 540 are adapted to receive the arms of the clip (not shown). A width W is defined between the camming surfaces 540 of the support member 500. The width W is sized to generally correspond with the un-flexed distance defined between the arms of the clip such that the arms of the clip may be flushly seated proximate the camming surface when the clip is disposed in the rest or first state (as shown, for example, in FIG. 20). A flex width FW is defined between shoulders 550 of the camming surfaces 540. The flex width FW is larger than the width W such that as the support member 500 rotates relative to the clip, such as by rotation or an applied key, the camming surfaces 540 proximate the shoulders 550 operate to drive the clip (not shown) from the first state to the flexed or second state.

Figure 6B:
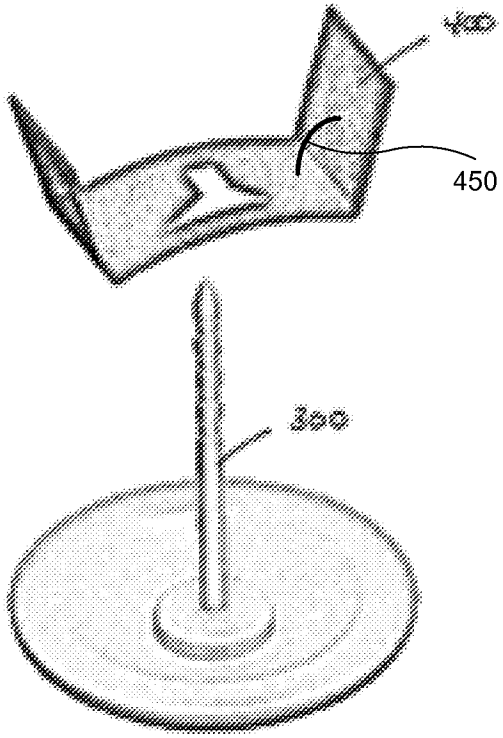
FIG. 6*b* is a perspective view of the pin and the clip of FIG. 6*a* in a disengaged configuration.
Figure 6A:
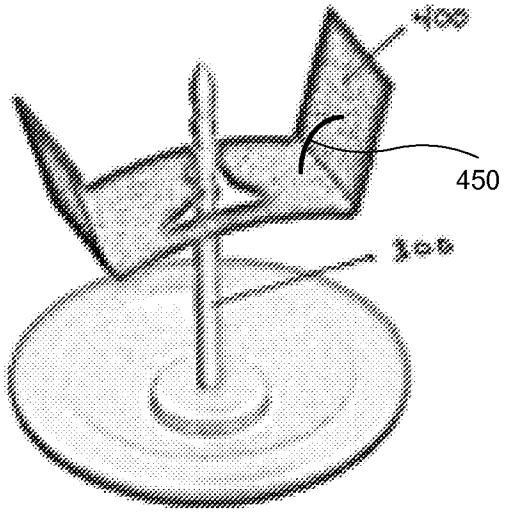
FIG. 6*a* is a perspective view of the pin and the clip of FIG. 4*a* with the pin being in a second state.

More specifically, the arms 420 & 430 are driven outwardly, e.g., as shown in FIGS. 6*a* and 6*b*, to define a flex angle 450 relative to the base 410 when the clip 400 is disposed in the second state. Due to the movement in the arms 420 & 430, the flap elements 412 are moved further apart causing the opening 414 of the clip 400 to expand, i.e., expanding from a first size for securing at least a portion of the pin 300 when the clip 400 is disposed in the first state to a second size, larger than the first size, for releasing the pin 300 when the clip 400 is disposed in the second state. With the expanded opening, the pin 300 is releasable from the clip 400 and, thus, from the housing 200. Therefore, according to the illustrated embodiment, rotation of the support member 500, as driven for example by rotation of an applied key, may be used to release the pin 300 from the housing 200.

Returning to FIGS. 9*e* and 18, the support member 500 may also define a channel 520 for receiving a portion of the pin. The channel 520 allows for the pin 300 to be further inserted into the housing 200 while maintaining a relatively compact design. In an embodiment of the invention, the opening 414 of the clip 400 (FIG. 4*a*) and the channel 520 of the support member 500 are positioned in substantially concentric alignment.

Figure 10A:
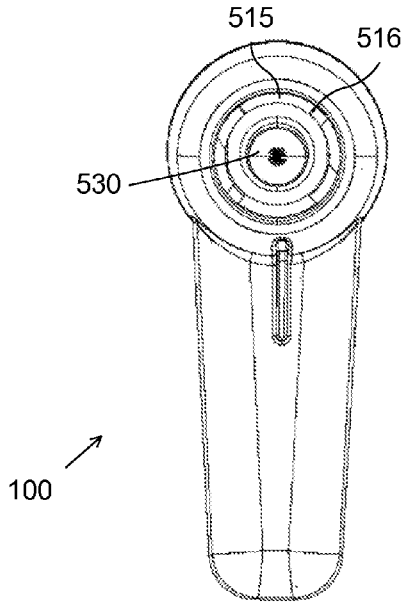
FIG. 10*a* is a top view of the security device of FIG. 1*b;*
Figure 10B:
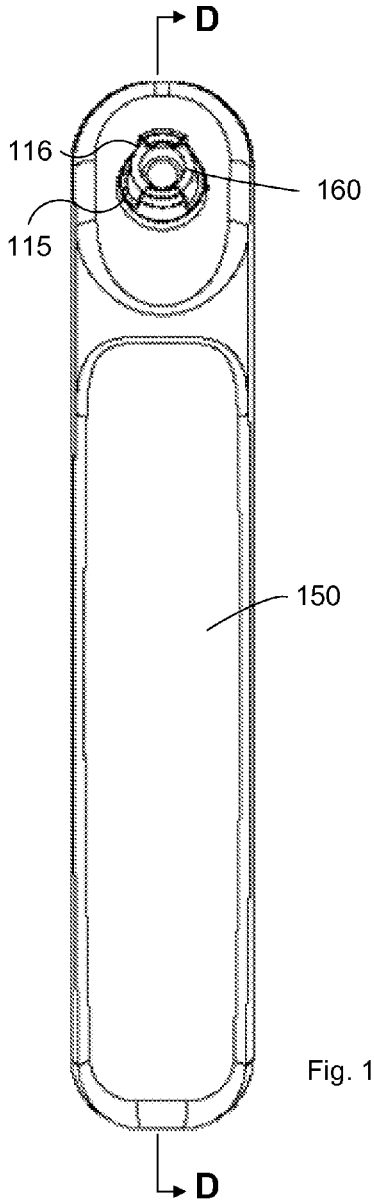
FIG. 10*b* is a bottom view of the key shown in FIGS. 1*c* through 1*f;*

The support member 500 further includes a top portion 530 that is accessible from outside the housing 200. The top portion 530 is configured to engage with a head 160 of the key 150, e.g., as shown in FIGS. 10*a* and 10*b*. Once engaged, the key 150 may be used to rotate the support member 500, e.g., as shown in FIGS. 1*c* through 1*f*. In one embodiment, the top portion 530 of the support member 500 may further define a key structure 515 that is configured to receive a reciprocally configured key structure 115 of a key 150. The reciprocally configured key structures 515, 115 of the support member 530 and key 150 are structured for two purposes: (1) to allow only properly structured (i.e., authorized) keys to unlock the security device, and (2) to define appropriate drive surfaces 116 on the key and driven surfaces 516 on the support member to facilitate key driven rotation of the support member. In the depicted embodiment, the top portion 530 of the support member 530 and the head 160 of the key 150 each define reciprocally configured complex geometries and shapes (i.e., key structures) to reduce the likelihood that a consumer or a would-be thief could copy the key 150 or find a substitute for the key 150 in order to try to rotate the support member 500 and release the pin 300.

In another embodiment, the lock 600 of the illustrated embodiment provides another layer of security. The lock 600 is moveable between a locked position and an unlocked position, e.g., as shown in FIGS. 9*a* through 9*d*. In the locked position, the lock 600 is configured to prevent the support member 500 from rotating by forming a mechanical lock between the lock 600, the support member 500 and the housing 200. For example, in the exemplary embodiment of a support member 500 illustrated in FIG. 9*e*, either a first lock element 620 or a second lock element 630 of the lock 600 engages the support member 500 at nub 560. Further, a tab 570 of the support member 500 engages a corresponding groove of the housing 200 preventing the support member 500 from continuing to rotate about the housing 200. Therefore, even if a thief could figure out a means for applying a rotational force onto the support member 500, e.g., by finding a substitute for the key 150, the lock 600 would still prevent the rotation of the support member 500 and, thus, the unauthorized release of the pin 300. In the unlocked position, the lock 600 is configured or positioned such that the lock 600 does not interfere with the rotation of the support member 500.

In the illustrated embodiment, the lock 600 includes a base 610, a lock element 620, and a second lock element 630. The base 610 extends from a first end to a second end. The first lock element 620 extends from the first end upwardly and generally perpendicular to the base 610. The second lock element 630 extends from the second end upwardly and generally perpendicular to the base 610. The base 610, the first lock element 620, and the second element 630 generally form a U-shape. The base 610 extends across the bottom of the support member 500 and defines an opening such that the lock 600 does not interfere with the insertion of the pin 300. Each lock element 620, 630 extends along a side of the support member 500 and each includes a flange 622, 632 that extends outwardly or perpendicular from the rest of the lock element 620, 630. Of course, in various embodiment, the lock elements 620, 630 must comprise a metal, such as a ferrous metal, that is susceptible to be acted upon by the magnetic force.

The lock 600 and the support member 500 may be rotatably connected, i.e., the rotation of one requires a rotation in the other, for example, by a rotational force that is applied about an axis of rotation. The connection may be formed through various means including opposing flanges, tabs, or ridges, fasteners, adhesives, welds or by inserting at least a portion of the lock through a reciprocally shaped channel or opening in the support member. In the locked position, the lock elements 620, 630 may be positioned to prevent rotation of the lock 600 and, thus, the support member 500 relative to the housing 200. For example, the flanges 622, 632 of the lock elements 620, 630 may engage a groove, channel, or other opening defined in the inner cylindrical wall of the housing 200. The lock elements 620, 630 may be biased in the locked position such that absent another force (i.e., a magnetic force) acting on the lock elements 620, 630, the lock elements 620, 630 remain in their originally biased position and, thus, the lock 600 remains in the locked position.

In another embodiment of the invention, as illustrated by FIGS. 9*e*, 19*a*-19*c*, and 20, the housing 200 may be configured to rotationally constrain the lock 600 in the locked position. For example, in one embodiment of the invention, the housing 200 may define an obstruction, such as grooves 212, 213, to rotationally constrain the lock 600 in the locked position. In the depicted embodiment, the grooves 212, 213 engage and rotationally constrain the flanges 622, 632 of the lock 600. As will be apparent to one of ordinary skill in the art in view of this disclosure, and as further discussed below, application of a properly oriented magnetic force operates to move the lock 600 (i.e., inwardly pull the lock elements 620, 630) from the locked position to the unlocked position where the lock 600 is free from the obstruction. In one embodiment of the invention, the support member 500 defines a nub 570 that is received into a channel 225 in order to restrict the rotation travel of the support member 500 when the lock 600 is disposed in the unlocked position.

The key 150 or, more specifically, the head 160 of the key 150 may be configured to move the lock elements 620, 630 from the locked position to the unlocked position. For example, the lock 600 may be made from a magnetic material such as an iron alloy. The head 160 of the key 150 may be configured to create a magnetic field 190 and produce a magnetic force, as illustrated in FIG. 1*g*, to move the lock elements 620, 630 inwardly to an unlocked position allowing rotation of the support member 500 and, thus, the release of the pin 300. For example, at least a portion of the head 160 may be made from a magnetized material or the head 160 may include one or more magnets.

Figure 12A:
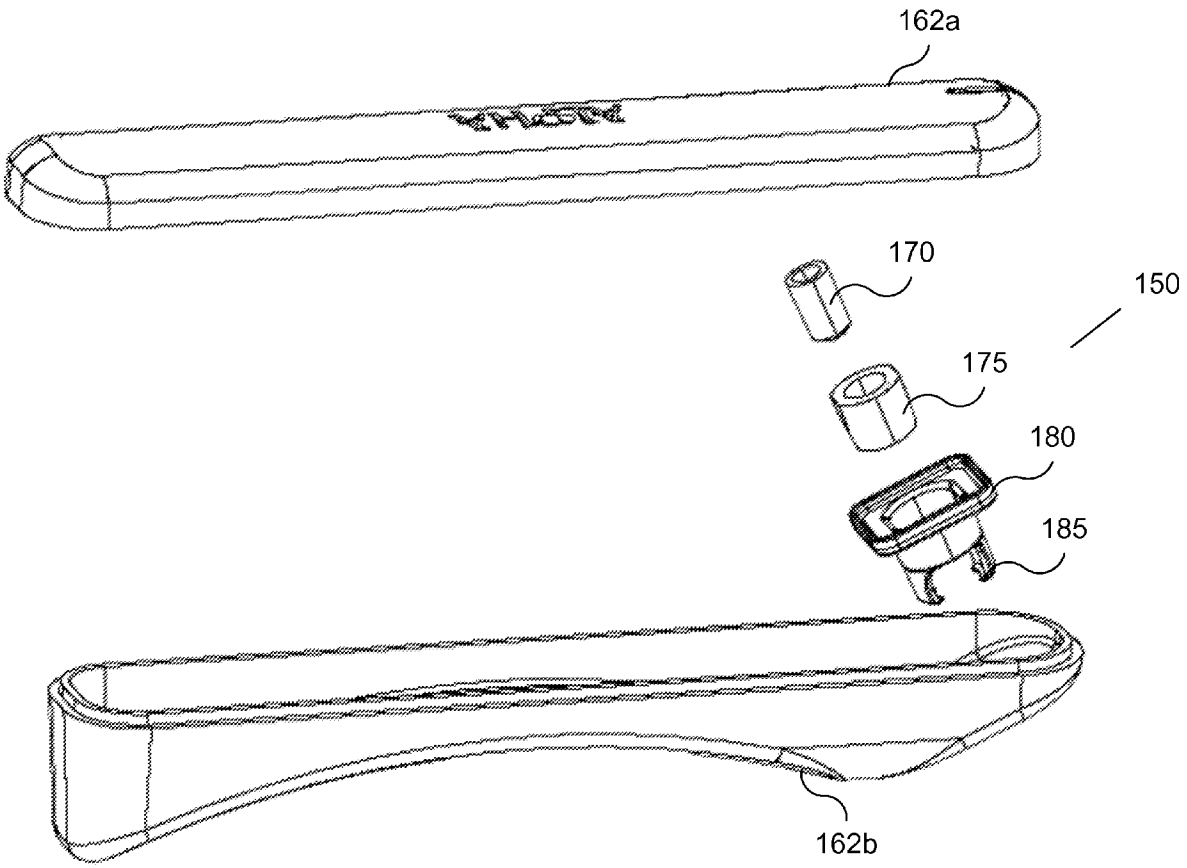
FIG. 12*a* is an exploded isometric view of the key shown in FIGS. 1*c* through 1*f;*
Figure 12B:
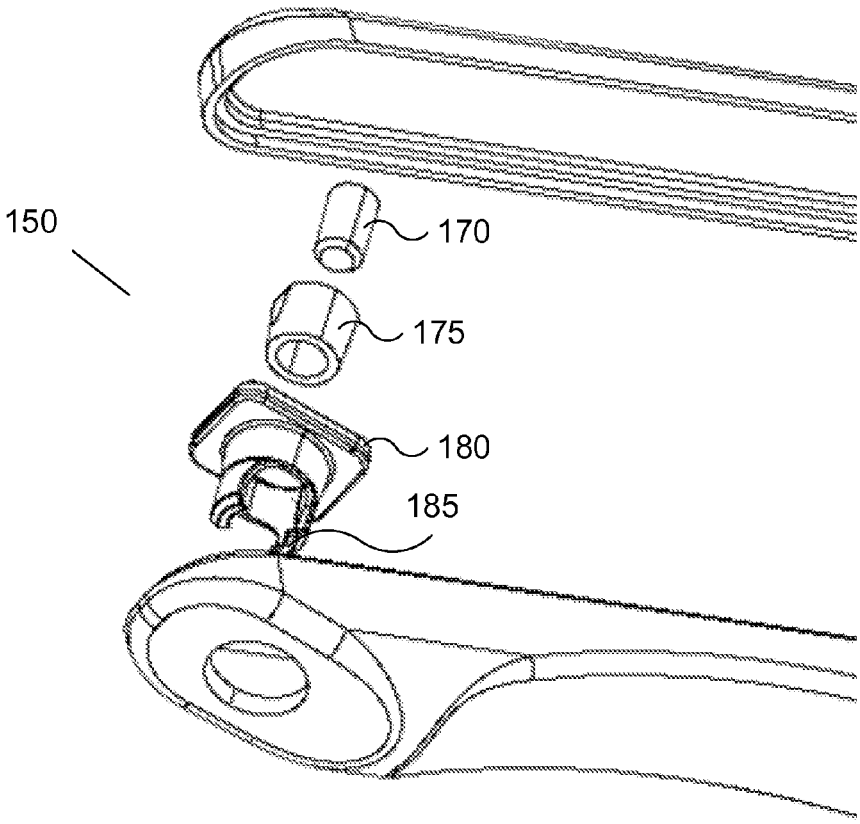
FIG. 12*b* is another exploded isometric view of the key shown in FIGS. 1*c* through 1*f;*
Figure 13:
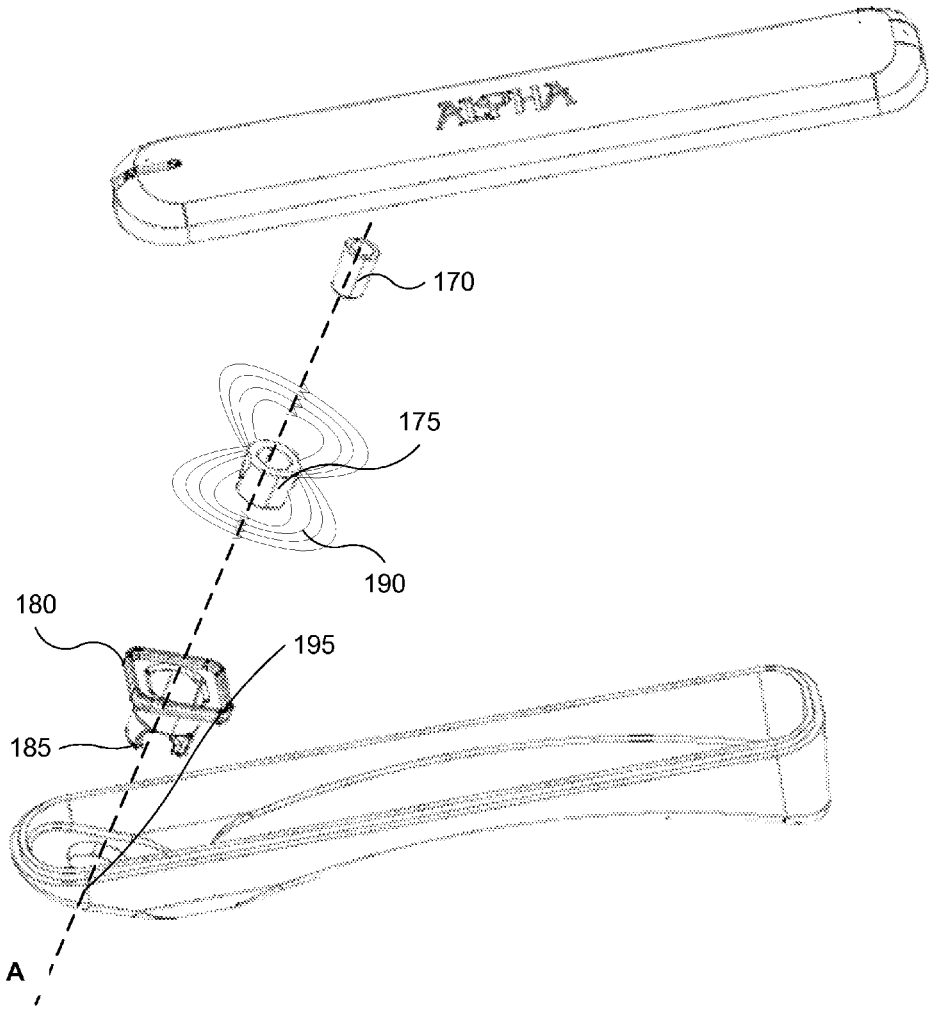
FIG. 13 is another exploded isometric view of the key shown in FIGS. 1*c* through 1*f;*

FIGS. 12*a*, 12*b*, and 13 are exploded isometric views of a key 150 structured in accordance with various embodiments of the invention. The key 150 comprises a body 162*a*, 162*b*, a plunger 170, a magnet 175, and a retaining sleeve 180. The retaining sleeve 180 is captured within the body 162 of the key 150 and combines with the magnet 175 and the plunger 170 to define the head 160 of the key 150. The depicted retaining sleeve 180 is captured and retained in the body by the lip 185 of the retaining sleeve 180.

Figure 1G:
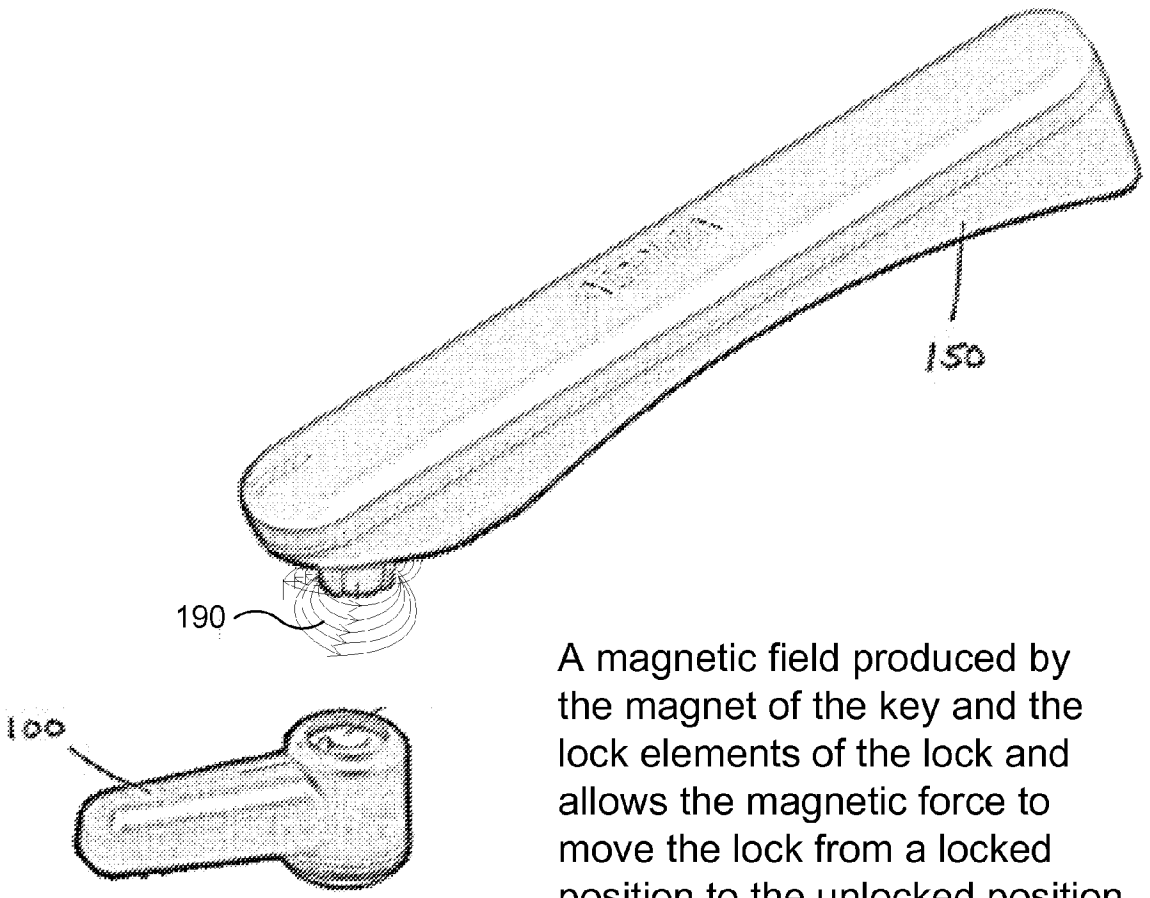
FIG. 1*g* is the security device and the key shown in FIGS. 1*c* through 1*e* depicting a simplified illustration of an exemplary magnetic field that may be produced by a diametrically oriented ring magnet supported by the key in accordance with one embodiment of the invention.
Figure 2:
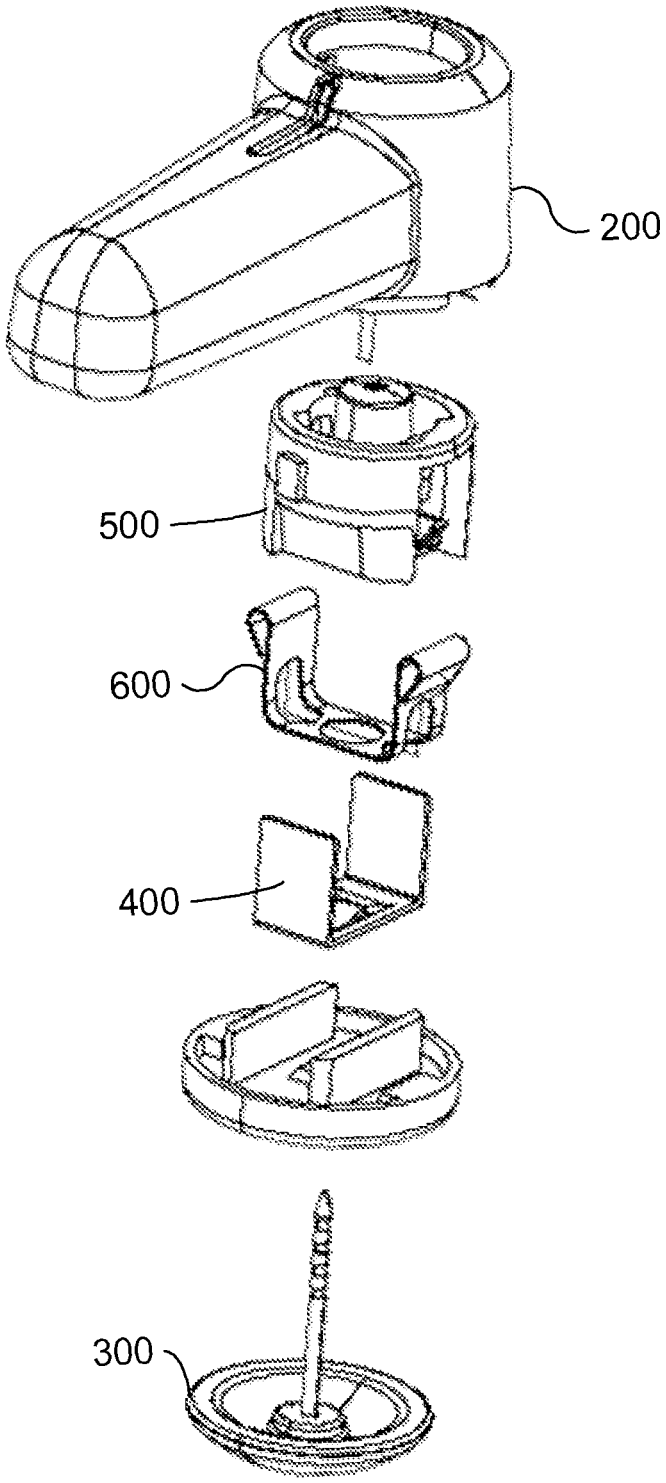
FIG. 2 is an exploded isometric view of the security device shown in FIGS. 1*a* and 1*b;*

Returning for definitional purposes to the key insertion illustration of FIG. 1*c*, we recall that the head 160 of the key 150 is structured for insertion into a cavity 105 defined by the security device 100. In the depicted embodiment, the head 160 of the key 150 is adapted to be inserted along an insertion axis A as shown. As will be discussed below in connection with FIGS. 1*g*, 13, and 14*a*-14*d*, the magnet 175 of the key head 160 produces a magnetic field that is diametrically aligned, rather than axially aligned, so as to produce a magnetic force that is operable in a direction that is generally orthogonal (i.e., in a direction of lock element movement as the lock transitions between an unlock state to a locked state) to the axis of insertion A.

Figure 14B:
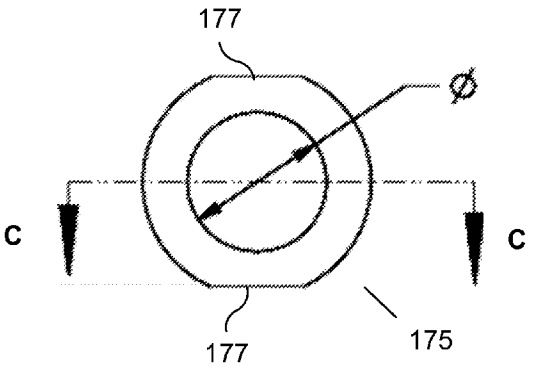
FIG. 14*b* is a top view of the magnet shown in FIG. 14*a;*
Figure 14A:
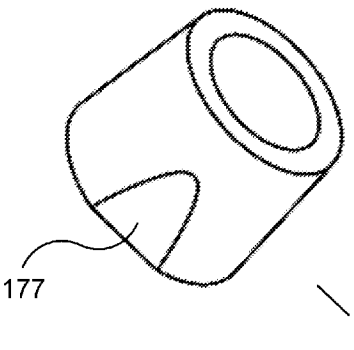
FIG. 14*a* is a perspective view of a magnet used in a key structured in accordance with one embodiment of the invention.
Figure 14C:
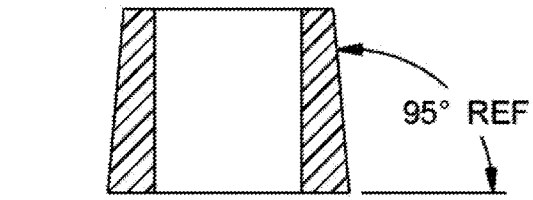
FIG. 14*c* is a cross-sectional view of the magnet of FIG. 14*b* taken along line C-C.
Figure 14D:
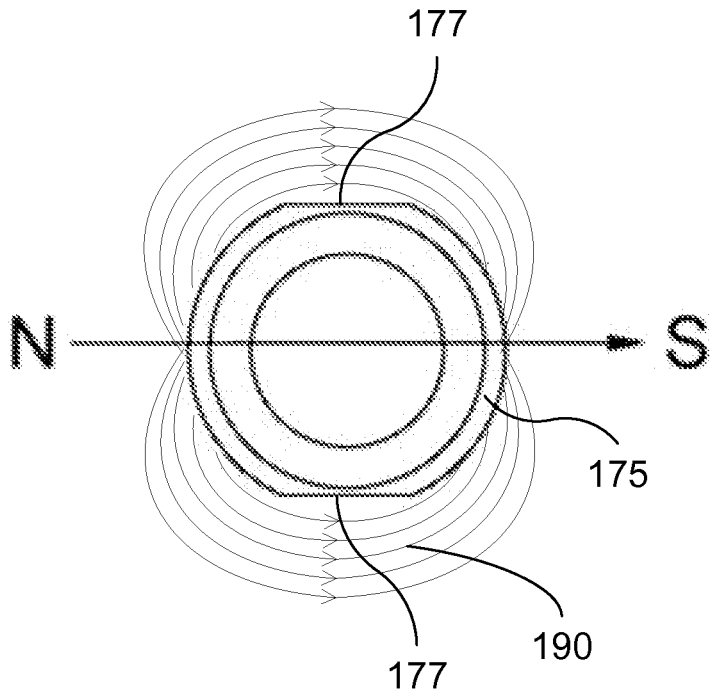
FIG. 14*d* is a top view of the magnet shown in FIG. 14*a*, wherein exemplary magnetic flux lines are shown to illustrate the diametrically magnetized nature of a ring magnet used in connection with various embodiments of the invention.
Figure 15A:
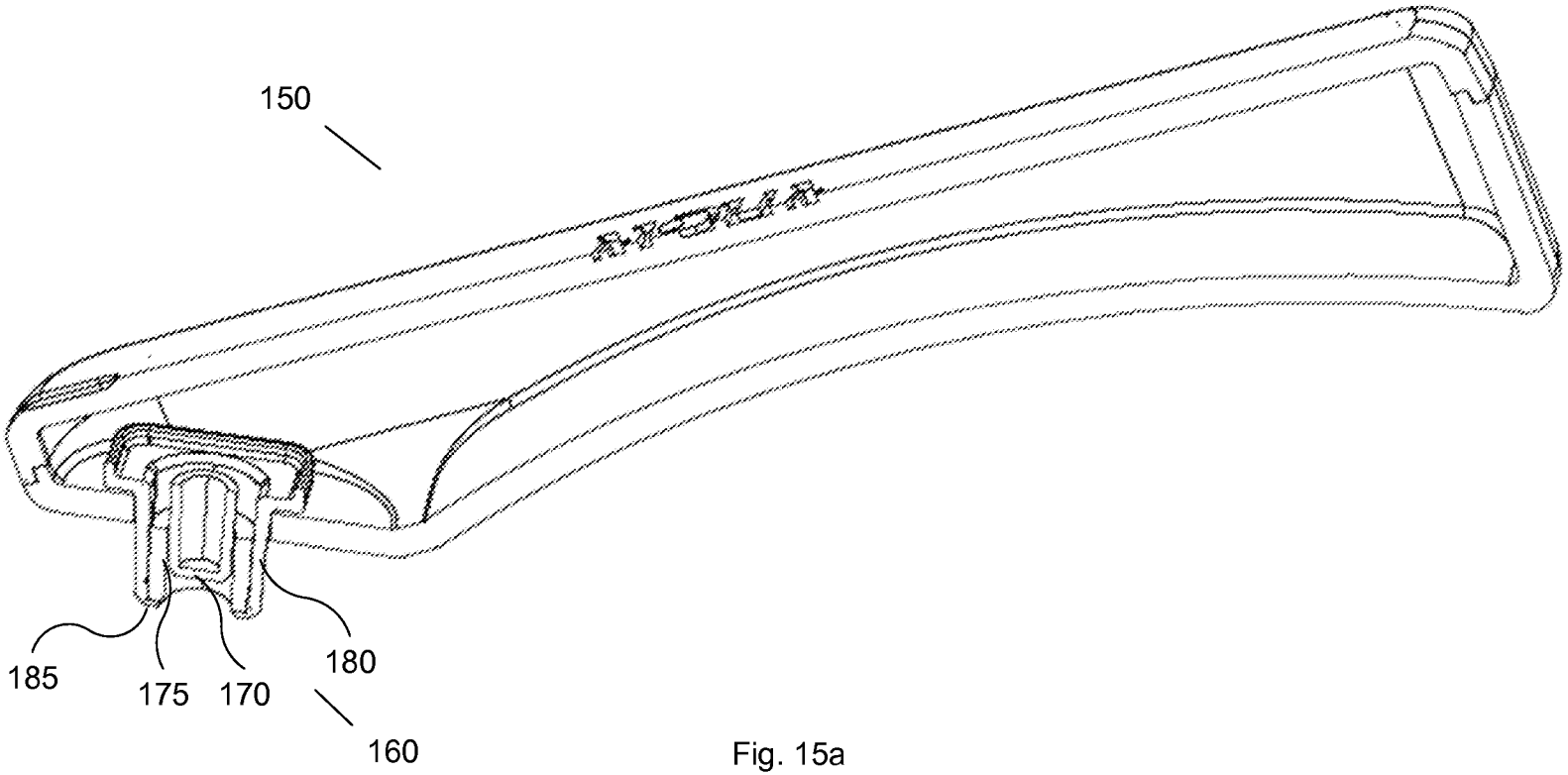
FIG. 15*a* is a sectioned isometric view of an assembled key taken along line D-D of FIG. 10*b;*
Figure 15B:
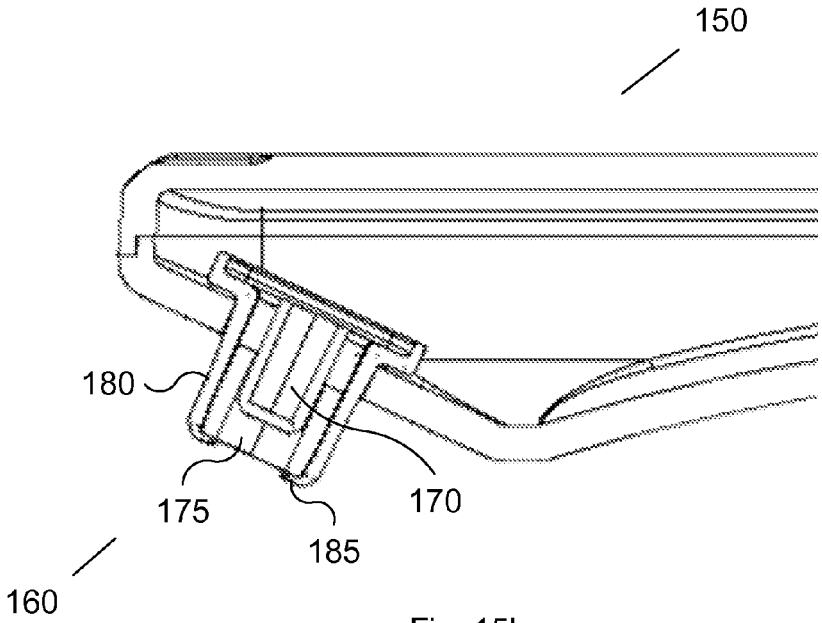
FIG. 15*b* is a sectioned right side view of the key taken along line D-D of FIG. 10*b;*
Figure 15C:
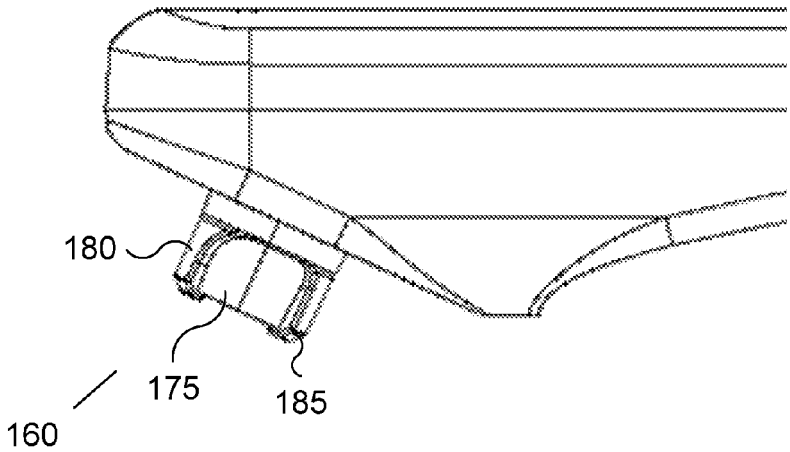
FIG. 15*c* is a right side view of the key as shown in FIG. 15*b;*

FIG. 14*a* is a perspective view of a magnet 175 structured for use in a key 150 in accordance with one embodiment of the invention. The depicted magnet 175 defines opposing flats or dimples 177 for locating the poles of the magnet 175 during mounting within the head 160 of the key 150. In one embodiment, as illustrated in FIGS. 14*b* and 14*d*, the magnet 175 defines dimples 177 that are offset by 90 degrees relative to the north N and south S poles of the magnet 175. Flux lines 190 are provided in FIGS. 13 and 14*d* to generally illustrate the diametrically aligned magnetic field produced by magnet 175.

In various embodiments of the invention, the magnet 175 is mounted within the head such that its north N and south S poles are positioned generally proximate the lock elements of the lock upon insertion of the head into the security device. As will be apparent to one of ordinary skill in the art, the reciprocal key structures of the head and the support member may also be structured to achieve this magnetic pole/lock element alignment. In this regard, magnets used in keys structured in accordance with various embodiments of the invention, are designed and structured to inwardly retract the lock elements from the locked position to the unlocked position.

In another embodiment of the invention, the axis of insertion A may also define an axis of rotation around which the key is configured to rotate. In this regard, a user need not re-position the key after insertion in order to rotate the key (and support member) to cam open the clip as discussed above.

As will be apparent to one of ordinary skill in the art in view of this disclosure, security devices structured in accordance with various embodiments of the invention provide at least two layers of security or at least two security features configured to prevent unwanted removal of the security device. The first layer is in the specific and uncommon shape of the top portion 530 (i.e., key structure) of the support member 500. In order to rotate the support member 500, one has to find a key 150 or other device that has a specific shape (i.e., reciprocally shaped key structure) that is configured to mate with the top portion 530. The second layer is the use of the lock 600 and the requirement to disengage the lock 600 (i.e., move lock elements 620, 630 inwardly) with a force, such as a magnetic force. The second layer is further enhanced by requiring that the force be produced by a ring magnet structured to produce a diametrically aligned, rather than an axially aligned, magnetic field.

Figure 11A:
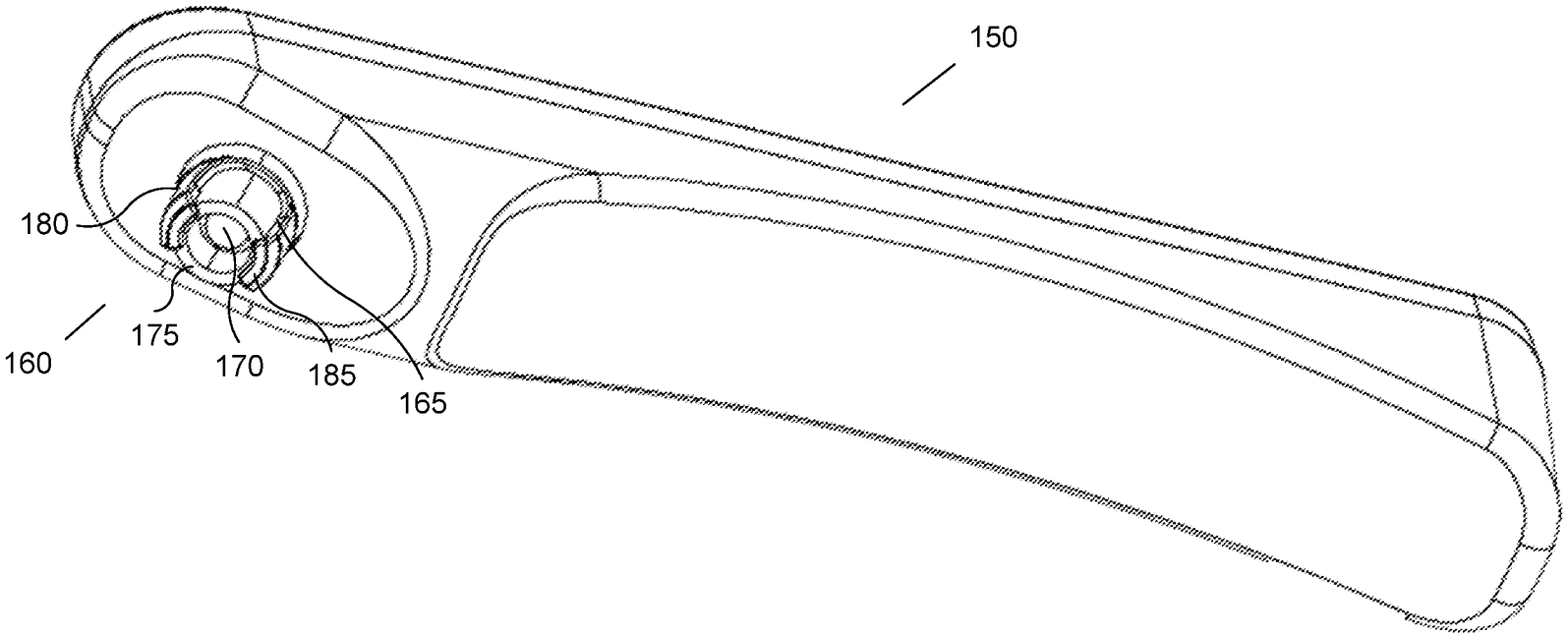
FIG. 11*a* is an isometric view of the key shown in FIGS. 1*c* through 1*f;*
Figure 11B:
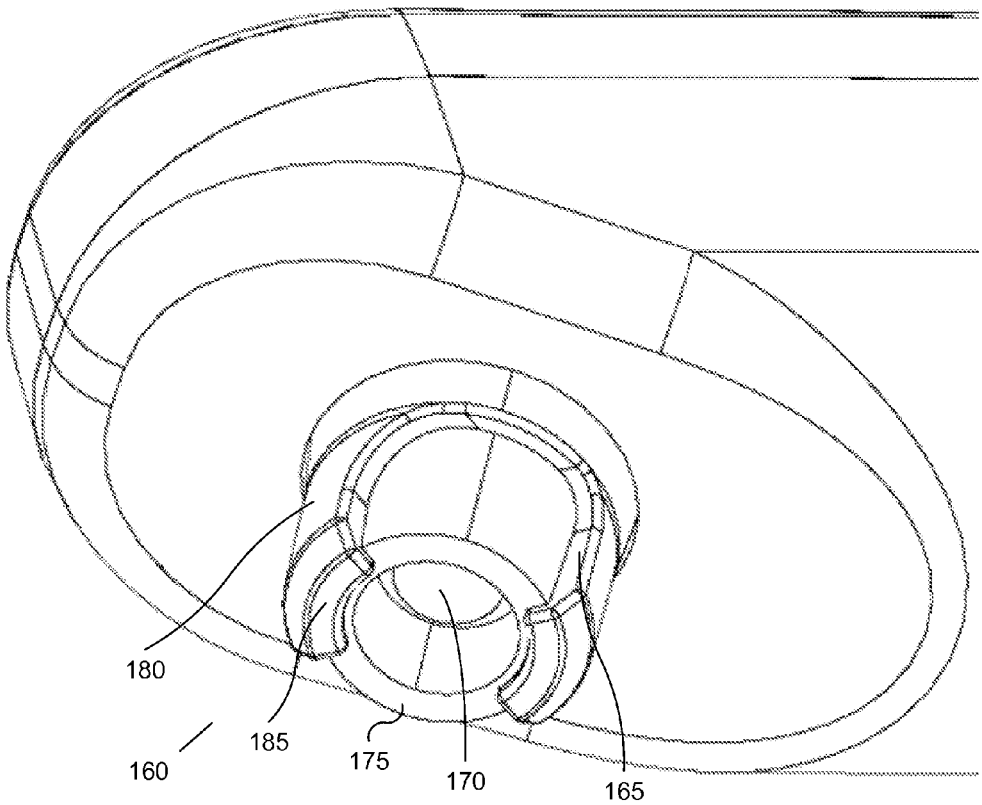
FIG. 11*b* is a perspective view of a head of a key of the invention.

A further depiction of the exemplary embodiment of the key 150 described above is illustrated in FIG. 11*b*. The head 160 may comprise a magnet 175 and a retaining sleeve 180 with the magnet 175 secured by lip 185 of retaining sleeve 180. A key structure 165 of the key 150 is configured to be received by a key structure of the support member. FIGS. 12*a* through 15*c* show the key 150 and further illustrate the relationship between the key 150 and the head 160 of the key 150.

Figure 3A:
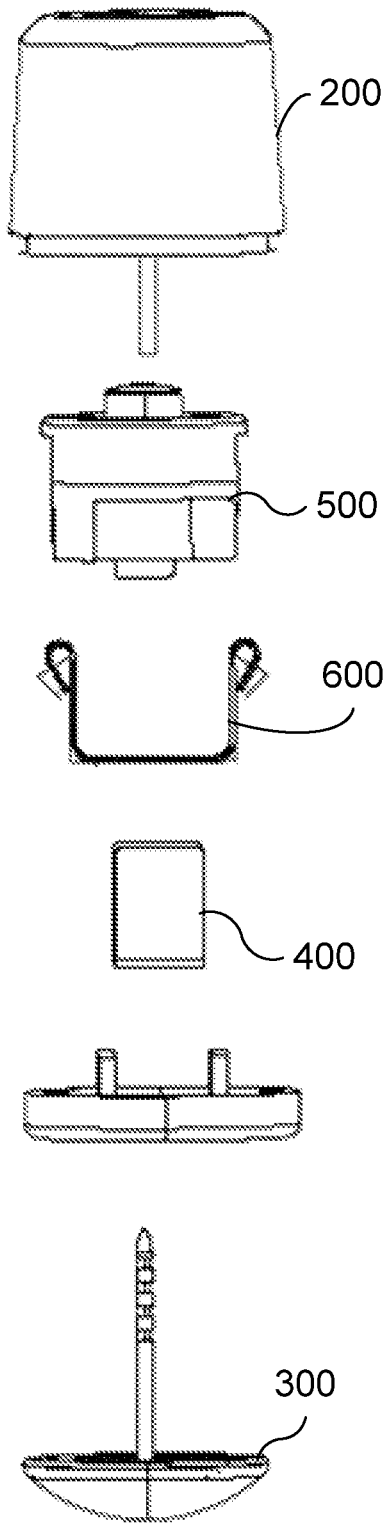
FIG. 3*a* is an exploded front view of the security device shown in FIGS. 1*a* and 1*b;*
Figure 3B:
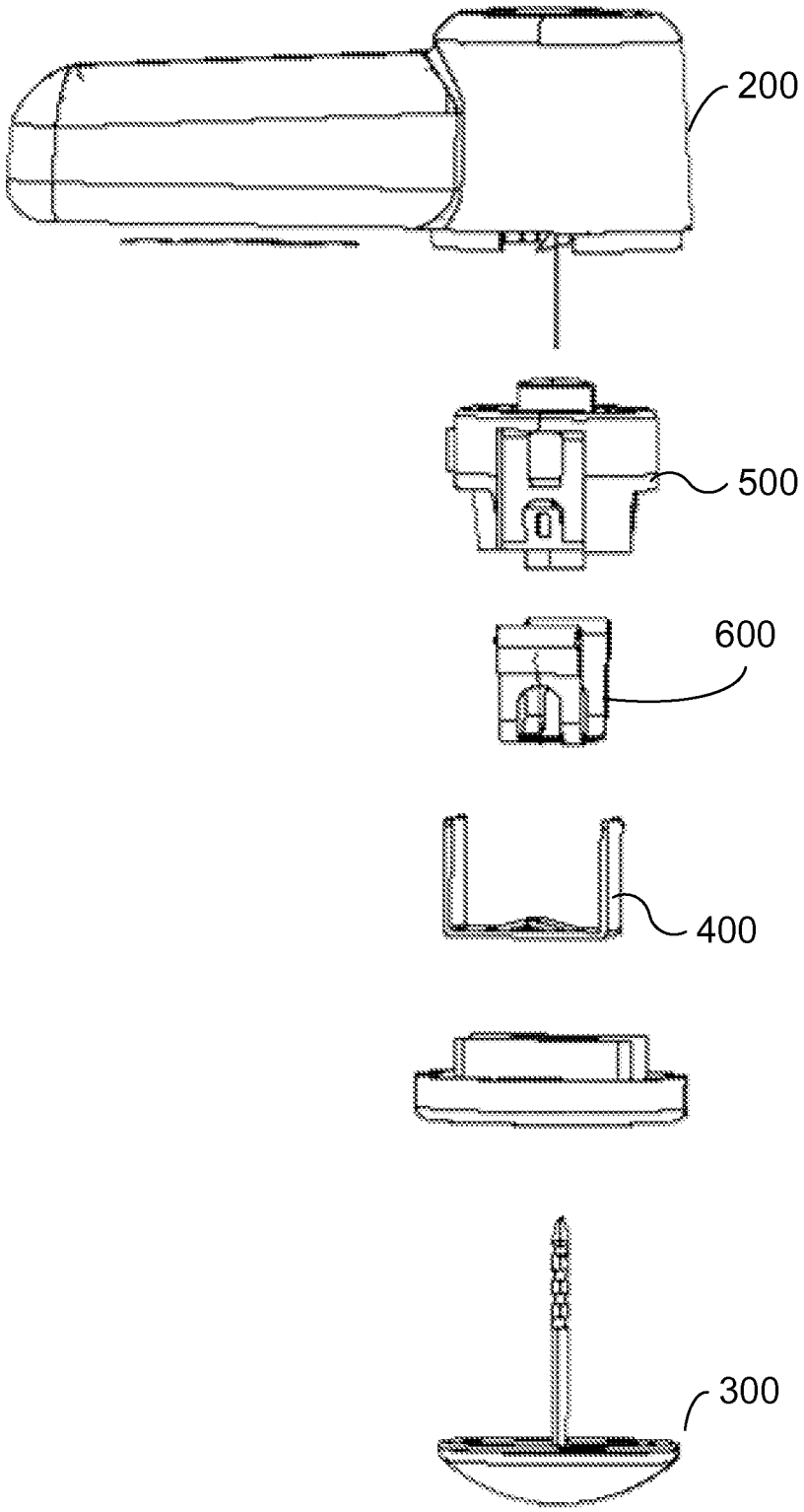
FIG. 3*b* is an exploded right side view of the security device shown in FIGS. 1*a* and 1*b;*
Figure 4B:
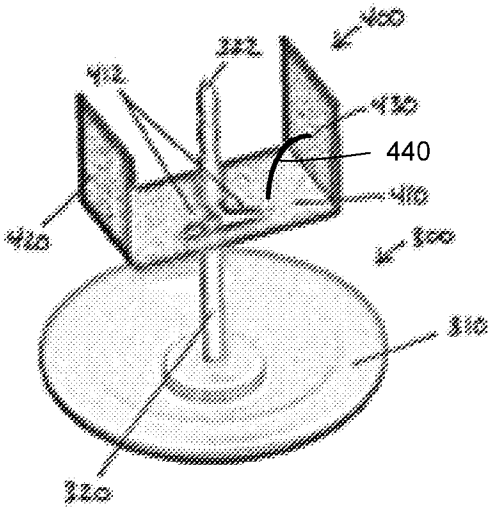
FIG. 4*b* is the perspective view of the pin and the clip of FIG. 4*a* in an engaged configuration.
Figure 4A:
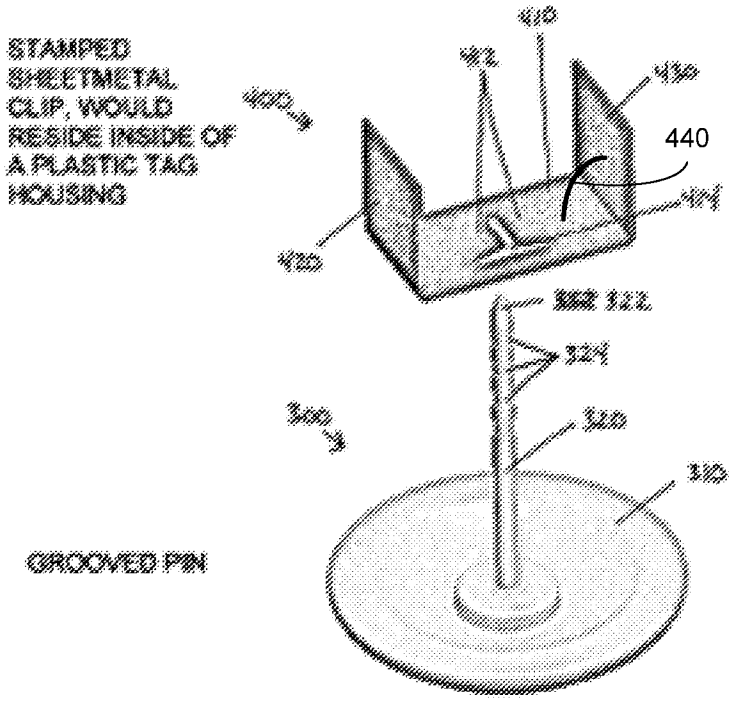
FIG. 4*a* is a perspective view of the pin shown in FIG. 1*a* and a clip of the security device of FIG. 1*a* in a disengaged configuration and the clip being in a first state.
Figure 16A:
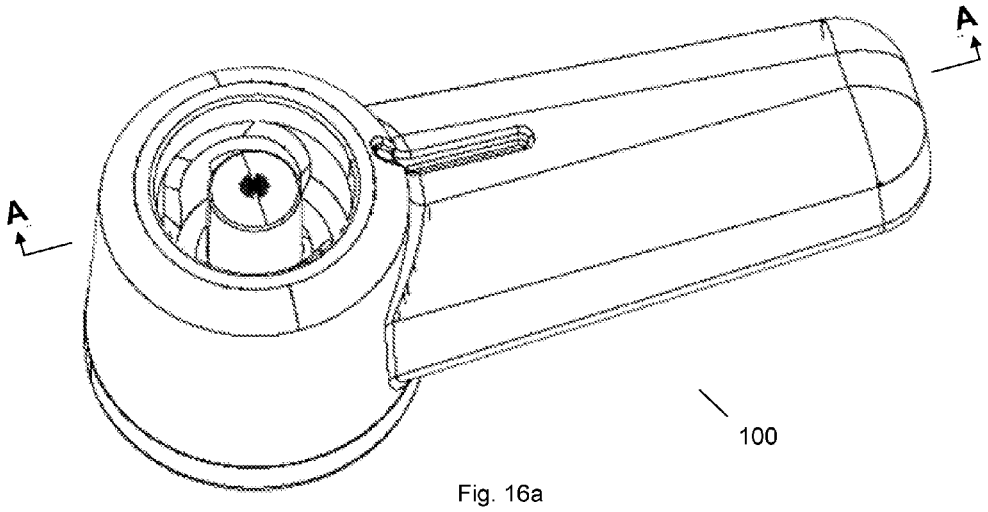
FIG. 16*a* is an isometric view of the security device shown in FIGS. 1*a* and 1*b;*
Figure 16B:
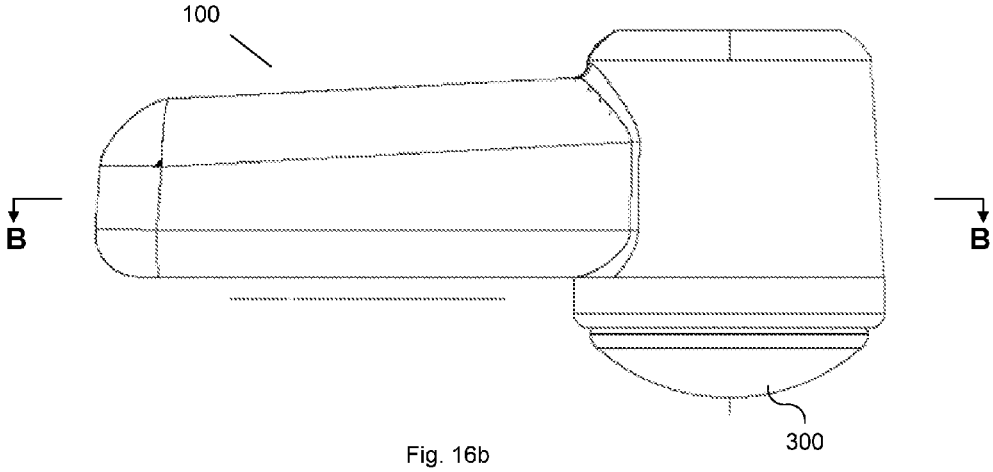
FIG. 16*b* is a right side view of the security device shown in FIGS. 1*a* and 1*b;*
Figure 16C:
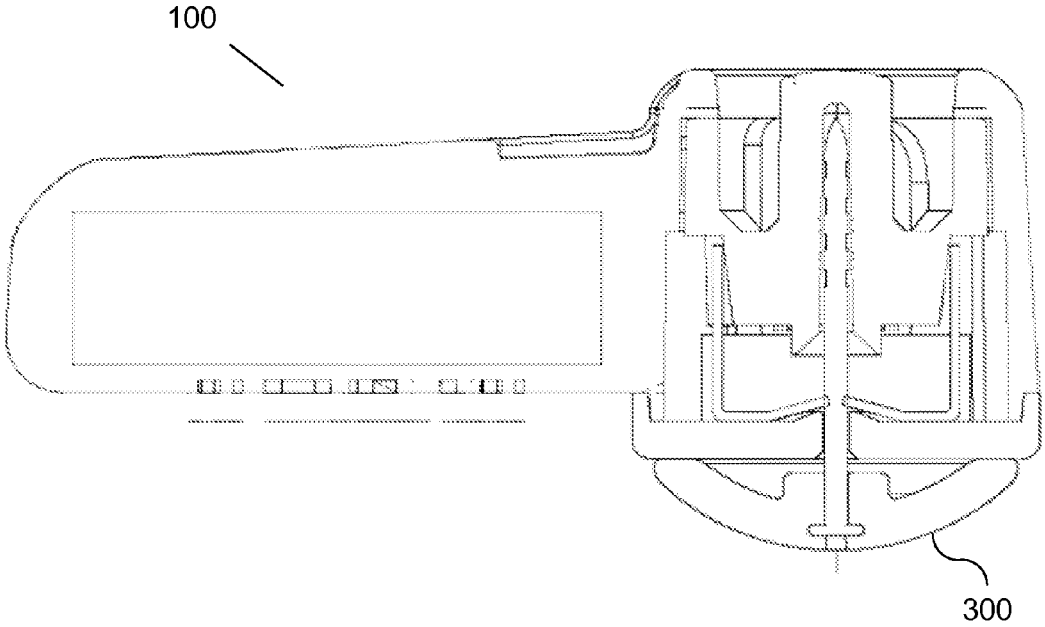
FIG. 16*c* is a sectioned right side view of the security device I taken along line A-A of FIG. 16*a;*
Figure 16D:
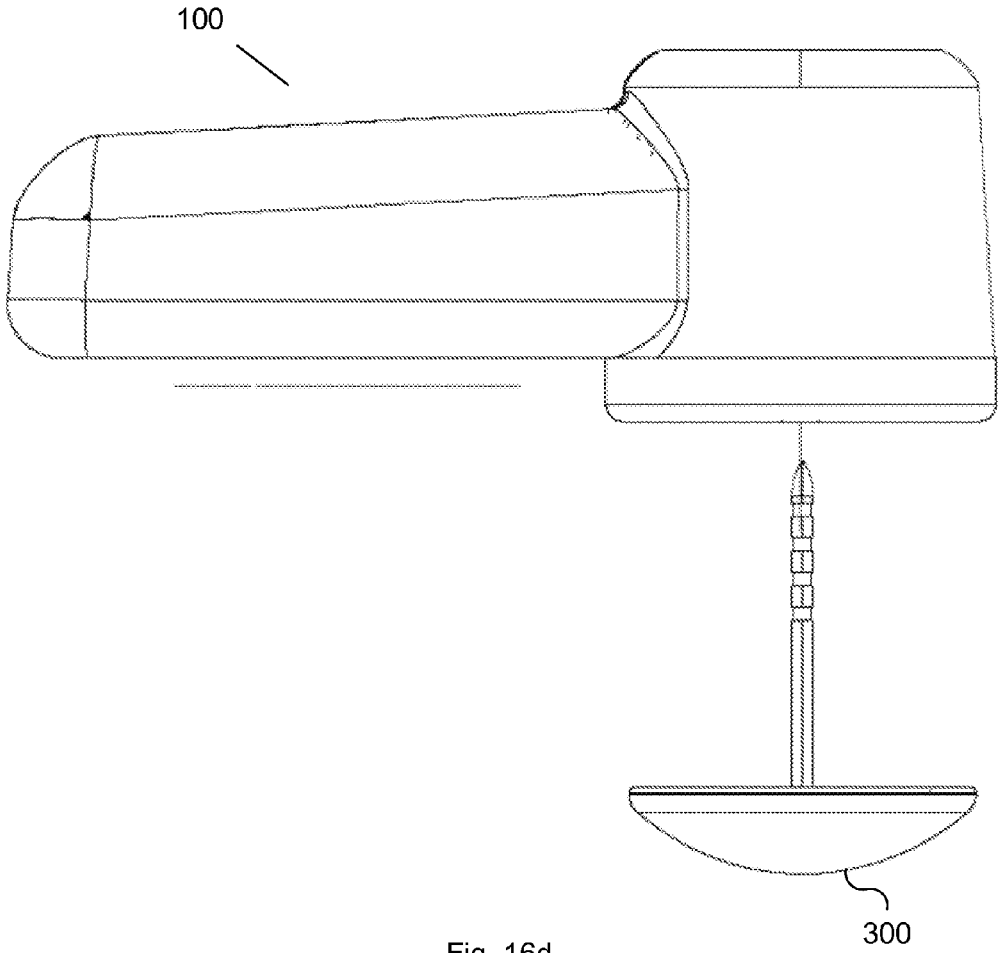
FIG. 16*d* is a right side view of the security device as shown in FIG. 16*b* with the pin removed.
Figure 16E:
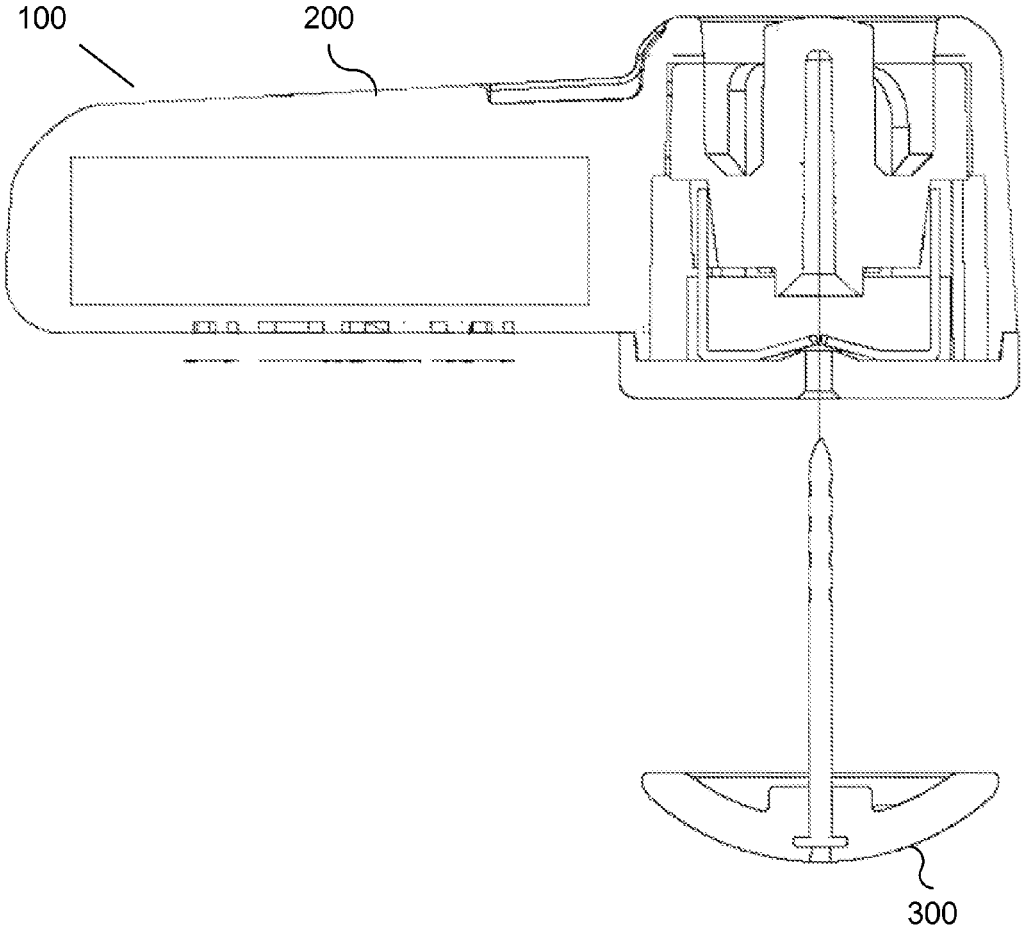
FIG. 16*e* is a sectioned right side view of the security device taken along line A-A of FIG. 16*a;*
Figure 16F:
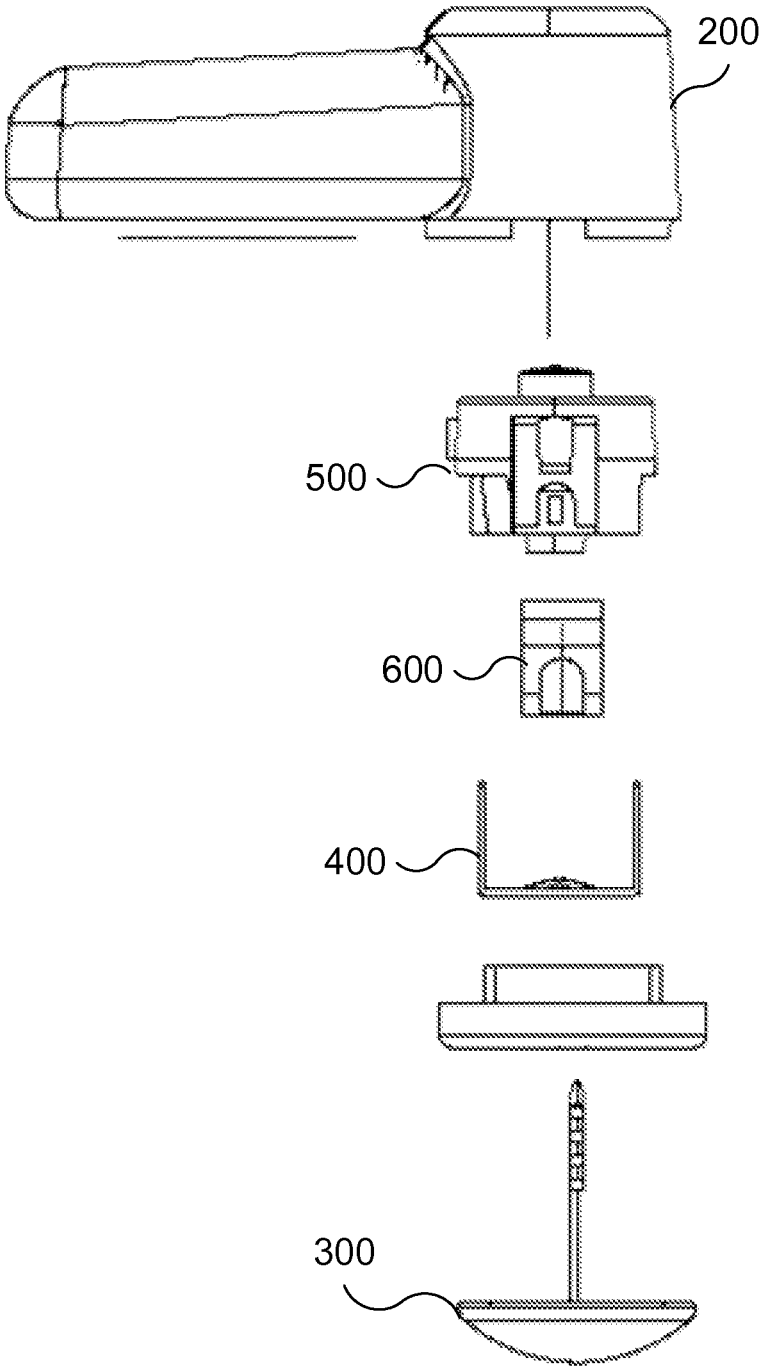
FIG. 16*f* is an exploded right side view of the security device shown in FIG. 16*b;*
Figure 16G:
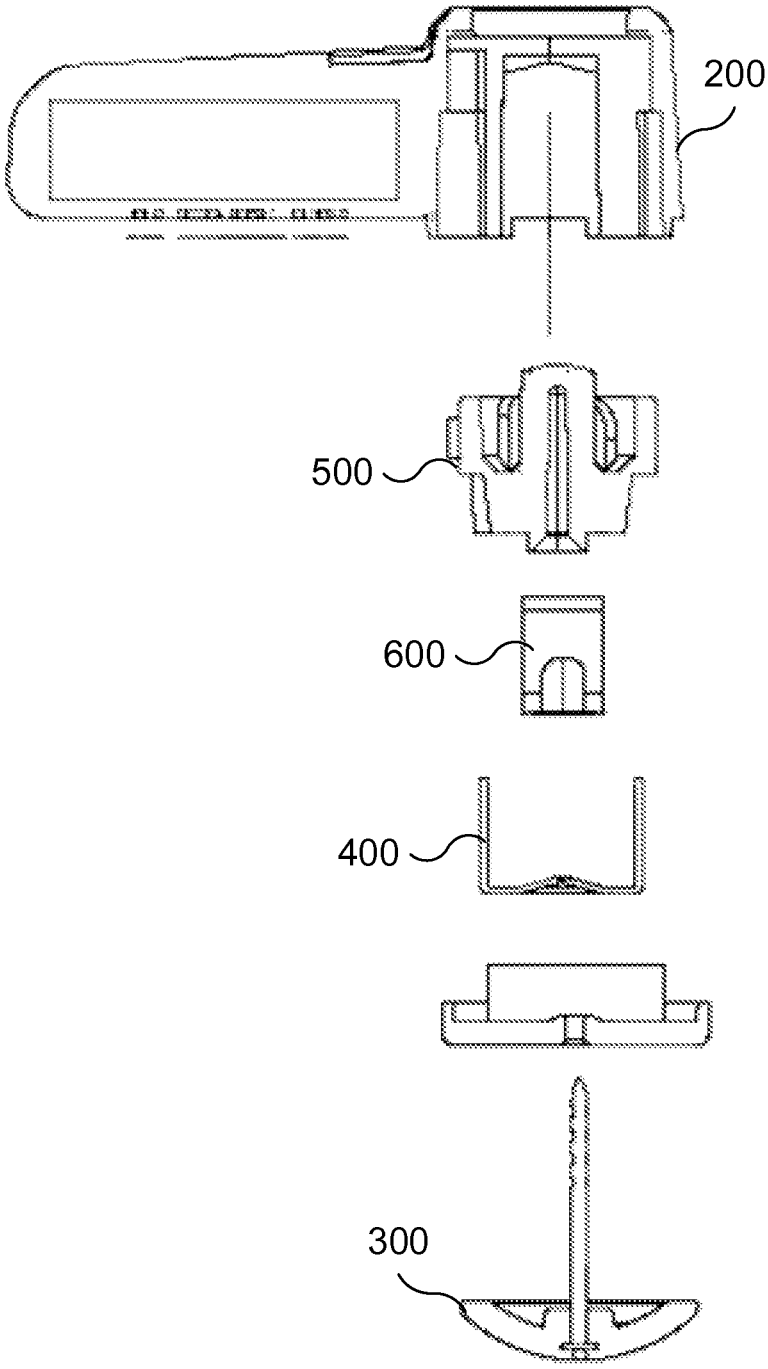
FIG. 16*g* is an exploded, sectioned right side view of the security device taken along line A-A of FIG. 16*a;*
Figure 17:
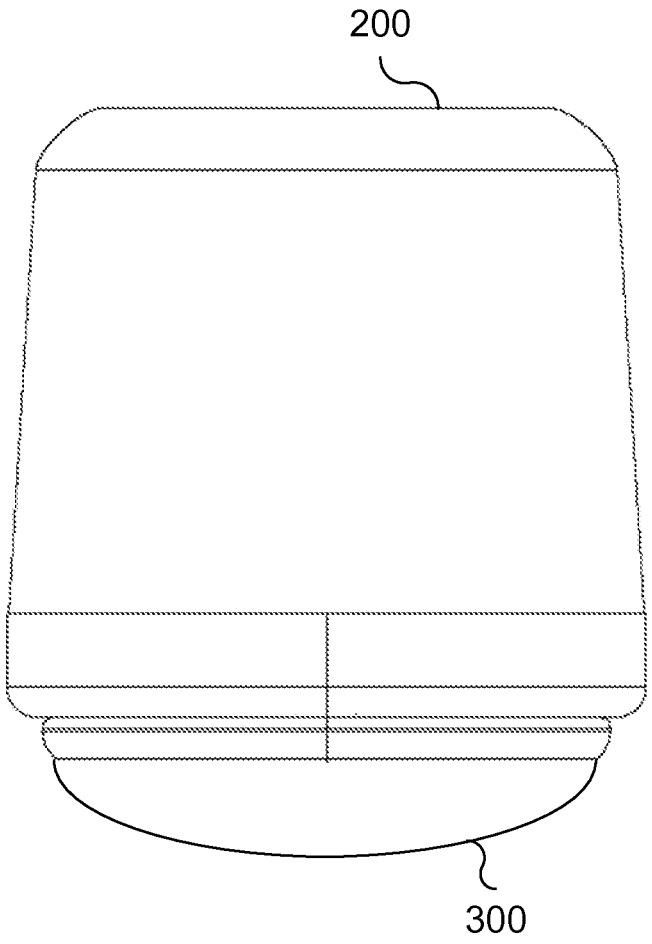
FIG. 17 is a front view of the security device shown in FIGS. 1*a* and 1*b;*
Figure 19A:
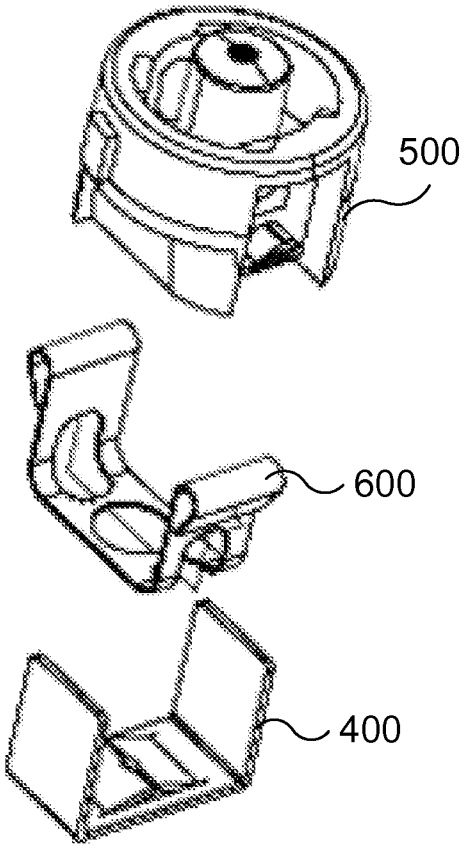
FIG. 19*a* is an isometric exploded view of the support member, clip, and lock as shown in FIGS. 8*c*, 8*e*, and 9*d;*
Figure 19B:
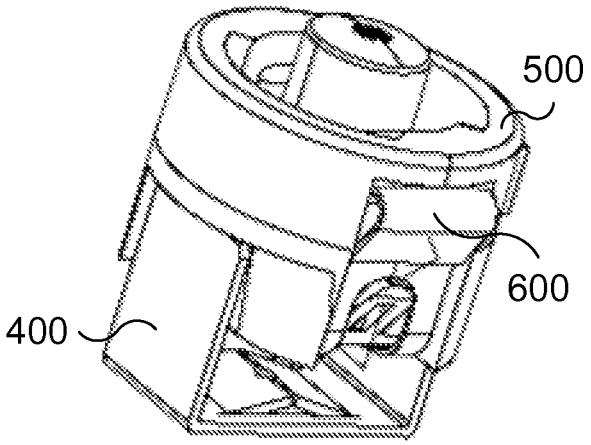
FIG. 19*b* is an isometric view of the support member, clip, and lock as assembled in the security device shown in FIGS. 1*a* and 1*b;*
Figure 19C:
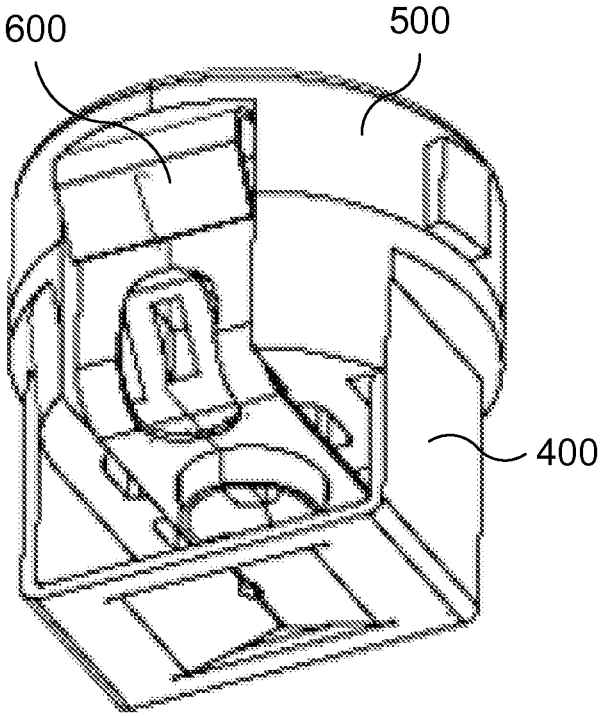
FIG. 19*c* is an isometric view of the bottom of the support member, clip, and lock as assembled in the security device shown in FIGS. 1*a* and 1*b;*
Figure 20:
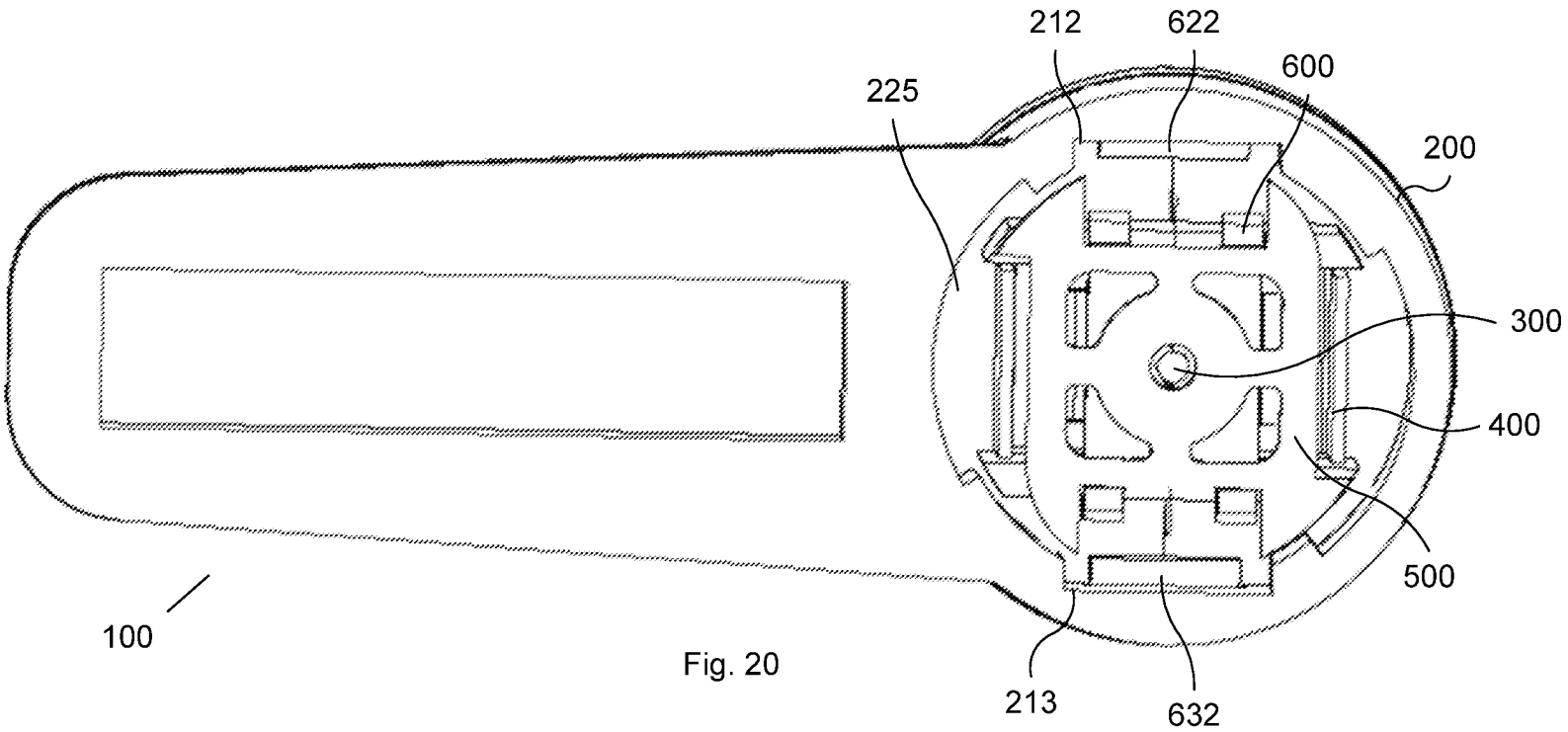
FIG. 20 is a bottom section view of the support member shown taken along line B-B of FIG. 16*b;*
Figure 21A:
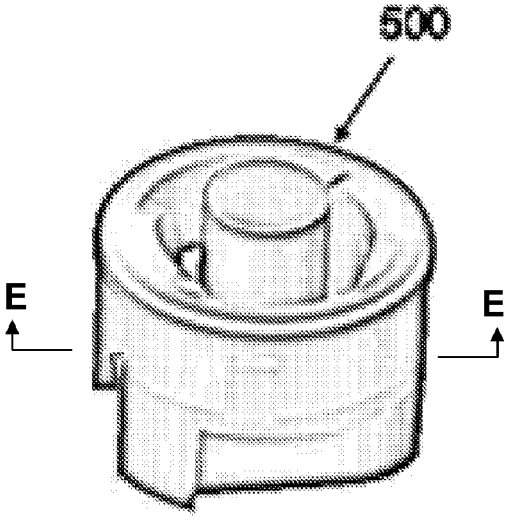
FIG. 21*a* is an isometric view of the support member shown in FIG. 8*e;*
Figure 21B:
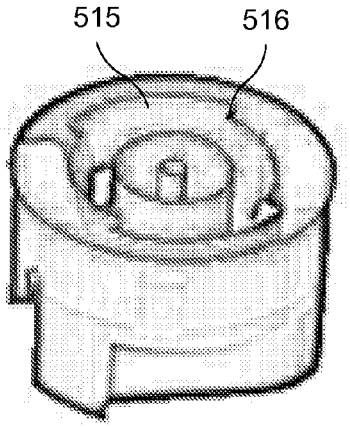
FIG. 21*b* is a sectioned isometric view of the support member taken along line E-E of FIG. 21*a;*

The security device of the exemplary embodiments described above is further illustrated in FIGS. 16*a* through 21. FIG. 16*a* shows the security device 100 with the pin installed and locked. FIG. 16*b* is a right side view of the security device 100 shown in FIG. 16*a*. FIG. 16*c* is a sectioned right side view of the security device 100 shown in FIG. 16*b*. FIG. 16*d* is a right side view of the security device 100 as shown in FIG. 16*b* with the pin 300 removed. FIG. 16*e* is a sectioned right side view of the security device 100 as shown in FIG. 16*d*. FIG. 16*f* is an exploded right side view of the security device shown in FIG. 16*b*. FIG. 16*g* is an exploded, sectioned right side view of the security device 100 shown in FIG. 16*f*. FIG. 17 is a front view of the security device 100 shown in FIGS. 16*a*-g. FIG. 18 is an exploded isometric view of the security device 100 shown in FIGS. 1*a* and 1*b*. FIG. 3*a* is an exploded front plan view of the security device 100 shown in FIGS. 1*a* and 1*b*. FIG. 3*b* is an exploded right side plan view of the security device 100 shown in FIGS. 1*a* and 1*b*. FIG. 18 is an isometric view of the bottom of the support member 500 as shown in FIG. 8*c*. FIG. 19*a* is an isometric exploded view of the support member 500, clip 400, and lock 600 as shown in FIGS. 8*c*, 8*e*, and 9*d*. FIG. 19*b* is an isometric view of the support member 500, clip 400, and lock 600 as assembled in the security device 100 shown in FIGS. 1*a* and 1*b*. FIG. 19*c* is an isometric view of the bottom of the support member 500, clip 400, and lock 600 as assembled in the security device 100 shown in FIGS. 1*a* and 1*b*. FIG. 20 is a bottom plan view of the support member 500 shown in FIG. 8*c*. FIG. 21*a* is an isometric view of the support member 500 shown in FIG. 8*e* and the sectional isometric view of FIG. 21*b* illustrates the keyway in the support member 500.

Figure 22A:
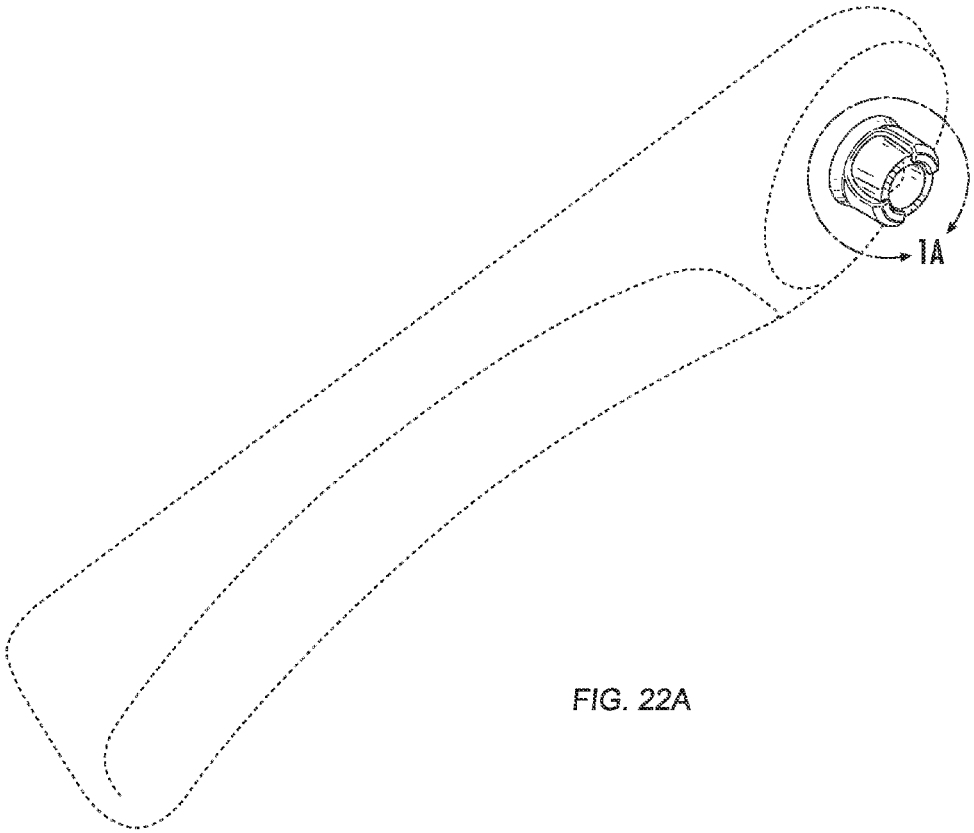
FIG. 22*a* is a perspective view of a key in accordance with one aspect of the invention.
Figure 22B:
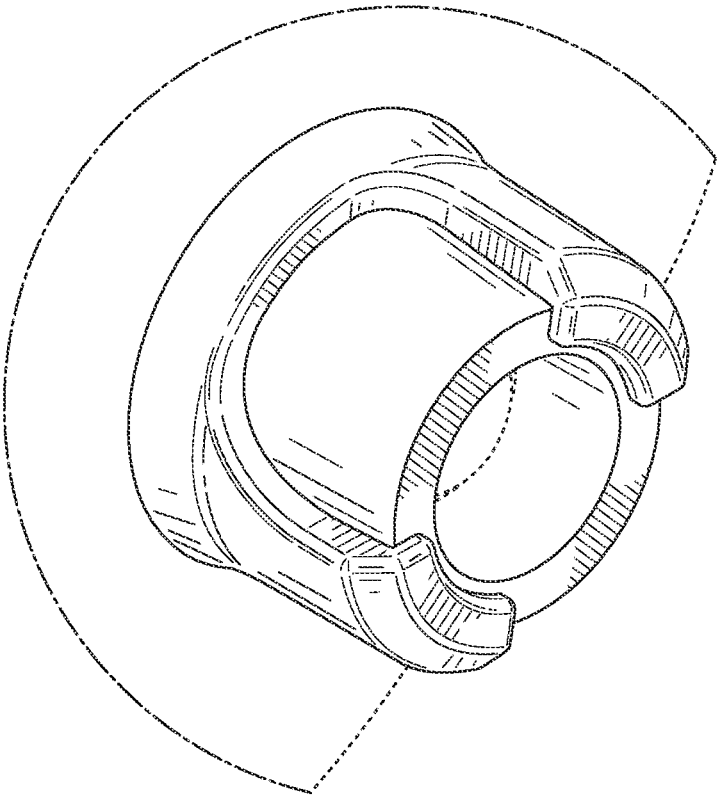
FIG. 22*b* is a perspective view of the head of the key taken about the 1A line of FIG. 22*a*.
Figure 23A:
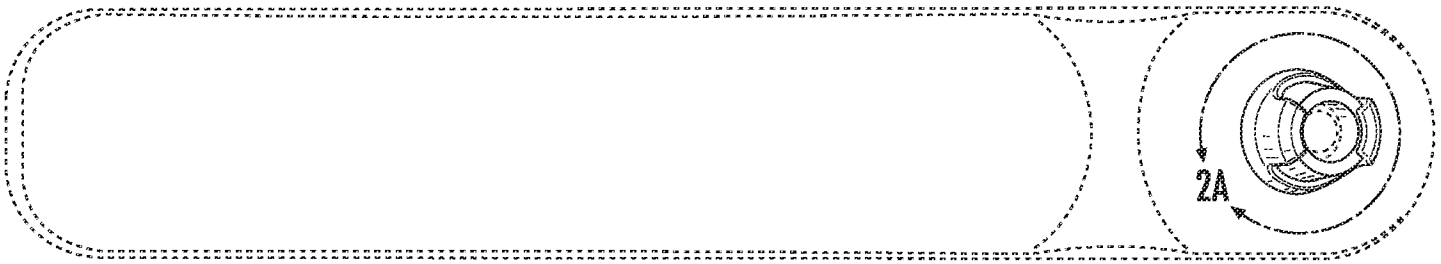
FIG. 23*a* is a bottom view of a key in accordance with one aspect of the invention.
Figure 23B:
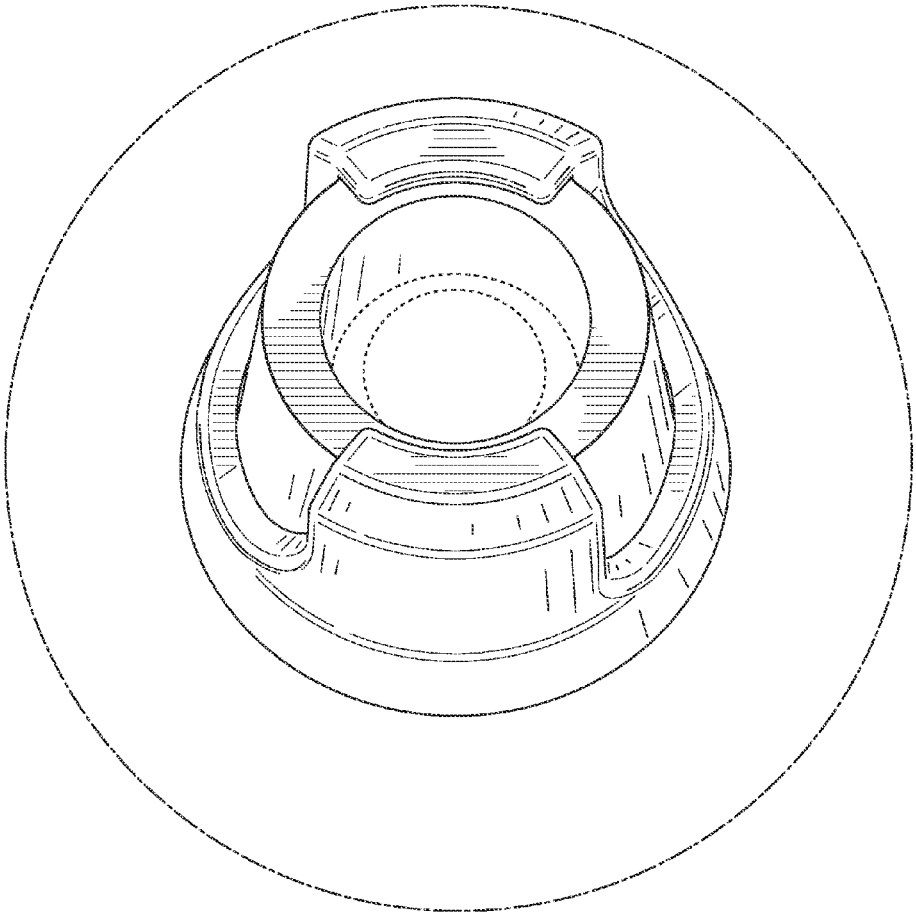
FIG. 23*b* is a bottom view of the head of the key taken about the 2A line of FIG. 23*a;*
Figure 24:
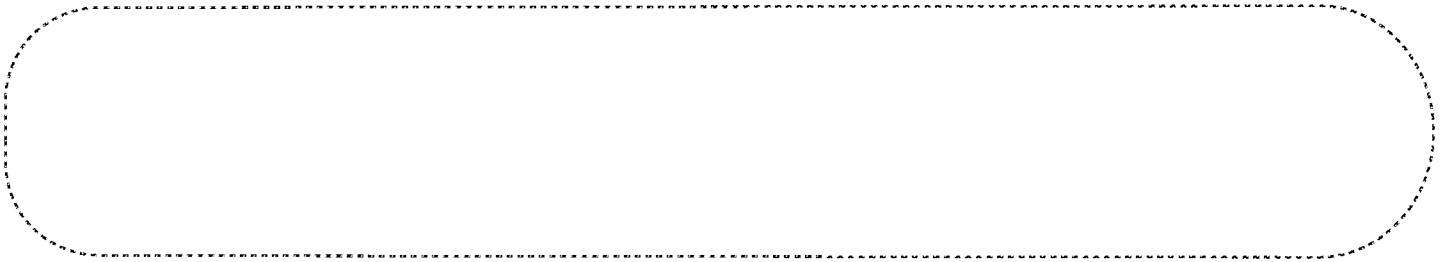
FIG. 24 is a top view of a key in accordance with one aspect of the invention.
Figure 25:
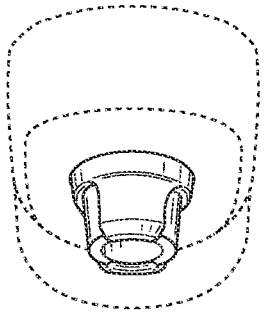
FIG. 25 is a front view of a key in accordance with one aspect of the invention.
Figure 26:
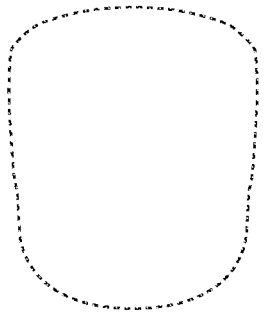
FIG. 26 is a back view of a key in accordance with one aspect of the invention.
Figure 27:
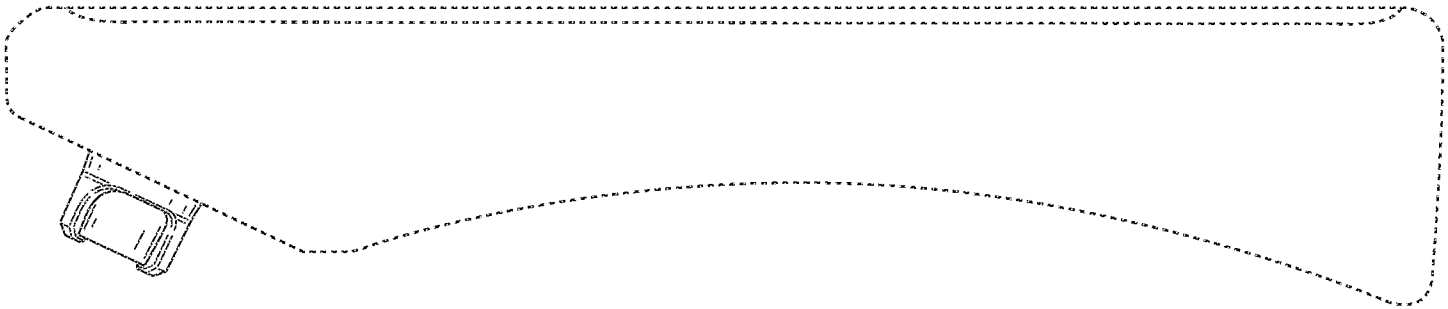
FIG. 27 is a right side view of a key in accordance with one aspect of the invention.
Figure 28:
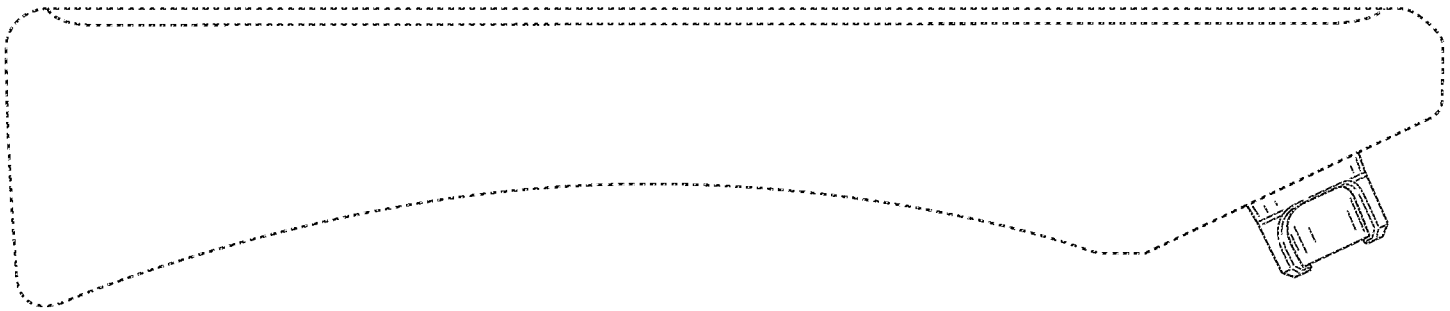
FIG. 28 is a left side view of a key in accordance with one aspect of the invention.

FIG. 22*a* is a perspective view of a key 150 according to an embodiment of the invention. FIG. 22*b* is a perspective view of the head 160 of the key 150 taken about the 1A line of FIG. 22*a*. Pursuant to this embodiment, FIGS. 23*a*, 24, 25, 26, 27, and 28 are respectively a bottom plan view, a top plan view, a front plan view, a back plan view, a right side plan view, and a left side plan view of a key 150 of the invention. FIG. 23*b* is a bottom view of the head 160 of the key 150 taken about the 2A line of FIG. 23*a*.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the disclosed embodiments and that modifications and other embodiments are intended to be included within the scope of the appended claims. Although specific terms are employed herein, they are used in a generic and descriptive sense only and not for purposes of limitation.

That which is claimed:

1. A security device structured for attachment to an object, the security device comprising:

a clip configured to be moveable between a first state and a second state, wherein the clip is configured to secure the object in the first state and further configured to release the object in the second state; and a support member positioned proximate the clip, wherein the support member defines a cam surface configured to engage the clip, and wherein rotation of the support member operates to drive the clip from the first state to the second state;

wherein the clip is configured to secure at least a portion of a pin in the first state and further configured to release the pin in the second state.

2. The security device of claim 1 further comprising a lock that is moveable between a lock position and an unlock position, wherein the lock is structured to prevent rotation of the support member in the lock position and to allow rotation of the support member in the unlock position.

3. The security device of claim 2, wherein application of a magnetic force operates to move the lock from the lock position to the unlock position.

4. The security device of claim 3, wherein the lock defines first and second lock elements that are deflected inwardly upon application of the magnetic force.

5. The security device of claim 2, further comprising a housing, wherein the housing is configured to rotationally constrain the lock in the lock position.

6. The security device of claim 5, wherein the housing is configured to at least partially enclose the lock, the support member, and the clip.

7. The security device of claim 2 further comprising a housing at least partially enclosing the lock, wherein the housing defines an obstruction to rotationally constrain the lock in the lock position, and wherein application of a magnetic force operates to move the lock from the lock position to the unlock position where the lock is free twin the obstruction.

8. The security device of claim 1 further comprising a security element.

9. The security device of claim 1, further comprising an electronic article surveillance tag.

10. The security device of claim 1, further comprising a radio frequency identification tag.

11. A security device structured for attachment to an object, the security device comprising:

a clip configured to be moveable between a first state and a second state, wherein the clip is configured to secure the object in the first state and further configured to release the object in the second state;

a support member positioned proximate the clip, wherein the support member defines a cam surface configured to engage the clip, and wherein rotation of the support member operates to drive the clip from the first state to the second state; and a lock that is moveable between a lock position and an unlock position, wherein the lock is structured to prevent rotation of the support member in the lock position and to allow rotation of the support member in the unlock position, wherein application of a magnetic force operates to move the lock from the lock position to the unlock position.

12. The security device of claim 11 further comprising a lock that is moveable between a lock position and an unlock position, wherein the lock is structured to prevent rotation of the support member in the lock position and to allow rotation of the support member in the unlock position.

13. The security device of claim 12, wherein application of a magnetic force operates to move the lock from the lock position to the unlock position.

14. The security device of claim 12, further comprising a housing, wherein the housing is configured to rotationally constrain the lock in the lock position.

15. The security device of claim 14, wherein the housing is configured to at least partially enclose the lock, the support member, and the clip.

16. The security device of claim 11, wherein the lock defines first and second lock elements that are deflected inwardly upon application of the magnetic force.

17. The security device of claim 11 further comprising a security element.

18. The security device of claim 11 further comprising an electronic article surveillance tag.

19. The security device of claim 11, further comprising a radio frequency identification tag.

20. A security device structured for attachment to an object, the security device comprising:

a clip configured to be moveable between a first state and a second state, wherein the clip is configured to secure the object in the first state and further configured to release the object in the second state;

a support member positioned proximate the clip, wherein the support member defines a cam surface configured to engage the clip, and wherein rotation of the support member operates to drive the clip from the first state to the second state;

a lock that is moveable between a lock position and an unlock position, wherein the lock is structured to prevent rotation of the support member in the lock position and to allow rotation of the support member in the unlock position; and a housing at least partially enclosing the lock, wherein the housing defines an obstruction to rotationally constrain the lock in the lock position, and wherein application of a magnetic force operates to move the lock from the lock position to the unlock position where the lock is free from the obstruction.

21. The security device of claim 20, wherein the lock defines first and second lock elements that are deflected inwardly upon application of the magnetic force.

22. The security device of claim 20 further comprising a security element.

23. The security device of claim 20, further comprising an electronic, article surveillance tag.

24. The security device of claim 20, further comprising a radio frequency identification tag.

* * * * *